US009914293B2

(12) United States Patent
Pinot et al.

(10) Patent No.: US 9,914,293 B2
(45) Date of Patent: Mar. 13, 2018

(54) SYSTEM FOR PREPARING AND PRODUCING A STAMP PLATE

(71) Applicant: Trodat GmbH, Wels (AT)

(72) Inventors: Jean-Philippe Pinot, La Varenne Saint Hilaire (FR); Stéphanie Verrier, Noiseau (FR)

(73) Assignee: Trodat GmbH (AT)

( * ) Notice: Subject to any disclaimer, the term of this patent is extended or adjusted under 35 U.S.C. 154(b) by 389 days.

(21) Appl. No.: 14/277,498

(22) Filed: May 14, 2014

(65) Prior Publication Data

US 2014/0339739 A1 Nov. 20, 2014

(30) Foreign Application Priority Data

May 15, 2013 (AT) ..... A 402/2013

(51) Int. Cl.

| | |
|---|---|
| ***B41C 1/02*** | (2006.01) |
| ***B41K 1/36*** | (2006.01) |
| ***B41K 1/38*** | (2006.01) |
| ***B41D 7/00*** | (2006.01) |
| *B41C 3/04* | (2006.01) |

(52) U.S. Cl.

CPC ..... *B41C 1/02* (2013.01); *B41D 7/00* (2013.01); *B41K 1/36* (2013.01); *B41K 1/38* (2013.01); *B41C 3/04* (2013.01); *Y10T 428/31663* (2015.04)

(58) Field of Classification Search

CPC ..... B23K 26/00; B23K 26/10; B41K 1/36; B41K 1/38; B41C 1/02; B41C 3/04; B41D 7/00; Y10T 428/31663; Y10T 428/14; Y10T 428/28

See application file for complete search history.

(56) References Cited

U.S. PATENT DOCUMENTS

| | | | | |
|---|---|---|---|---|
| 3,814,656 A * | 6/1974 | Hanson et al. | ..... | B29C 33/3857 156/580.2 |
| 5,473,982 A * | 12/1995 | Hirata | ..... | B41K 1/32 101/128.21 |
| 5,816,160 A * | 10/1998 | Taira | ..... | B41K 1/04 101/327 |
| 5,996,493 A * | 12/1999 | Okumura | ..... | B41K 1/02 101/108 |
| 6,276,272 B1 * | 8/2001 | Takami | ..... | B41K 1/50 101/327 |

(Continued)

*Primary Examiner* — Patricia L. Nordmeyer
(74) *Attorney, Agent, or Firm* — Lerner, David, Littenberg, Krumholz & Mentlik, LLP

(57) ABSTRACT

The invention describes a system for preparing and producing a stamp plate, comprising at least one input device, a control device, and a processing device, with a processing insert and apertures arranged therein. The processing device, in particular a laser plotter, comprises a processing table, which is designed to accommodate and position the processing insert, in particular a tray or jig for at least one stamp plate blank, wherein a removal aid is allocated to at least one aperture of the processing insert, and/or this aperture preferably comprises means for guiding and positioning the insert. In particular the stamp plate blank and/or the workpiece. In order to attain an even surface of a base material of the stamp plate blank, for further processing the base material is positioned on a base plate in a removable manner.

10 Claims, 13 Drawing Sheets

(56) References Cited

U.S. PATENT DOCUMENTS

Figure 1:
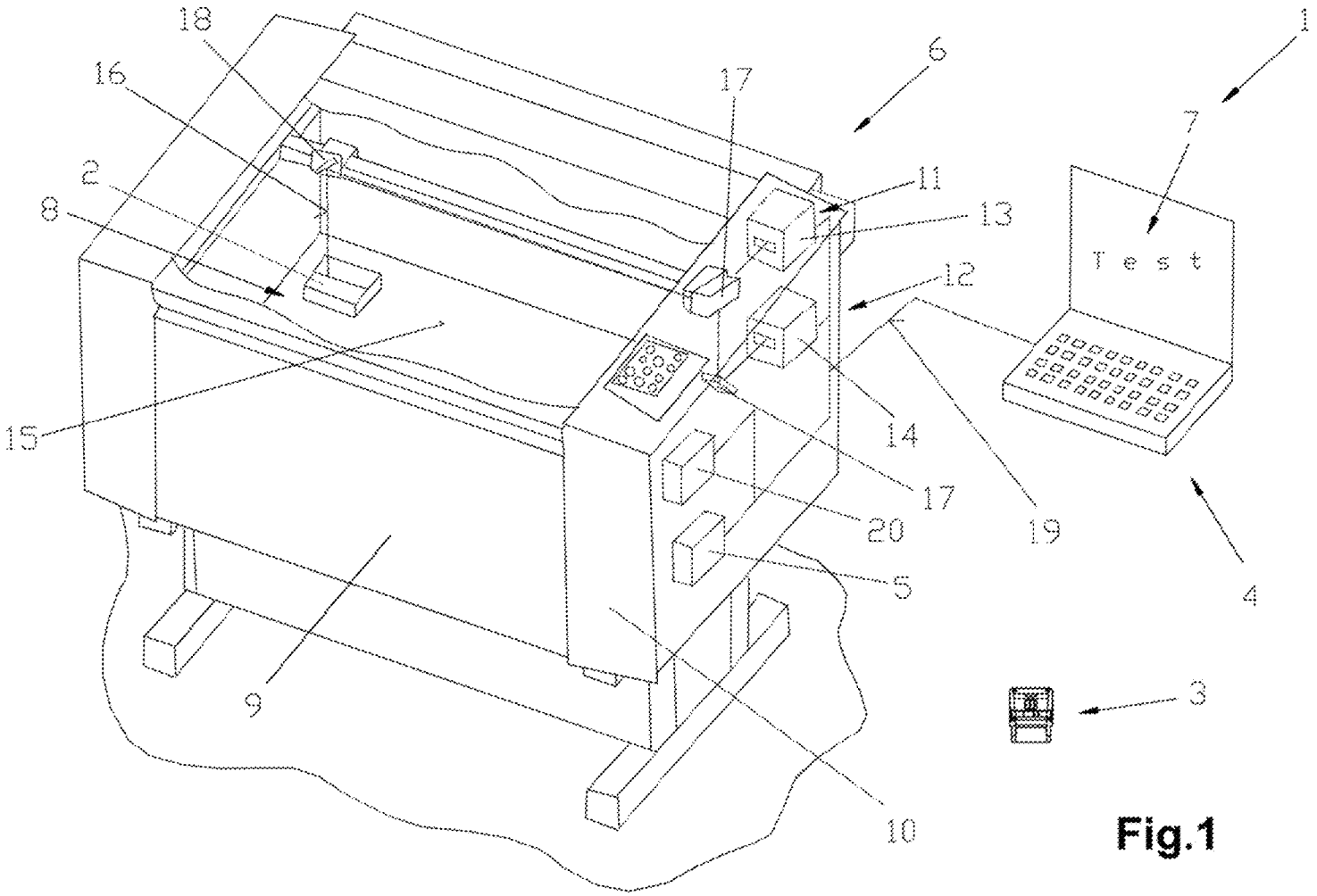

| | | | | |
|---|---|---|---|---|
| 6,634,288 | B1 * | 10/2003 | Imamaki | B41K 1/02 101/125 |
| 6,822,192 | B1 * | 11/2004 | Young | B28D 1/221 219/121.69 |
| 7,875,313 | B2 * | 1/2011 | Blanchet | B41M 3/006 427/272 |
| 2002/0098364 | A1 * | 7/2002 | Bernard | B41C 3/04 428/447 |

* cited by examiner

Fig.2
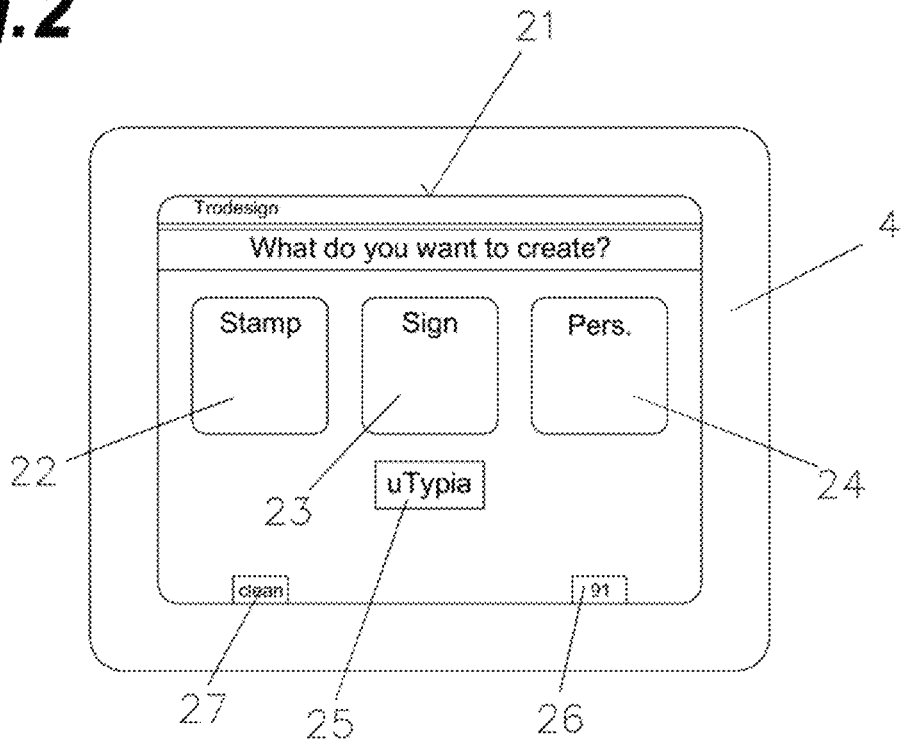
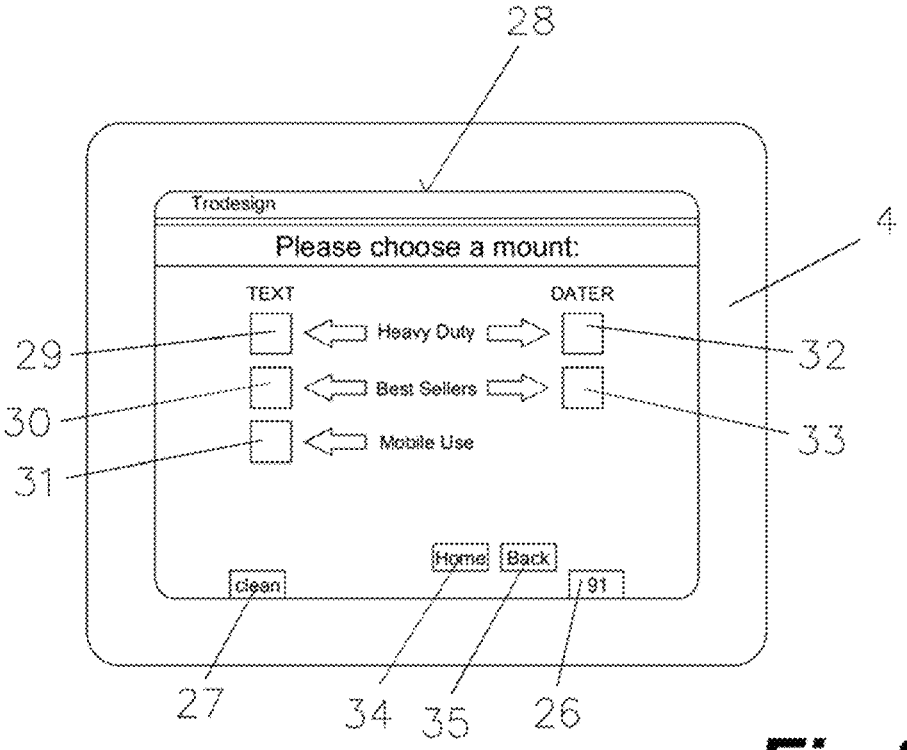
Fig.3

Fig.4
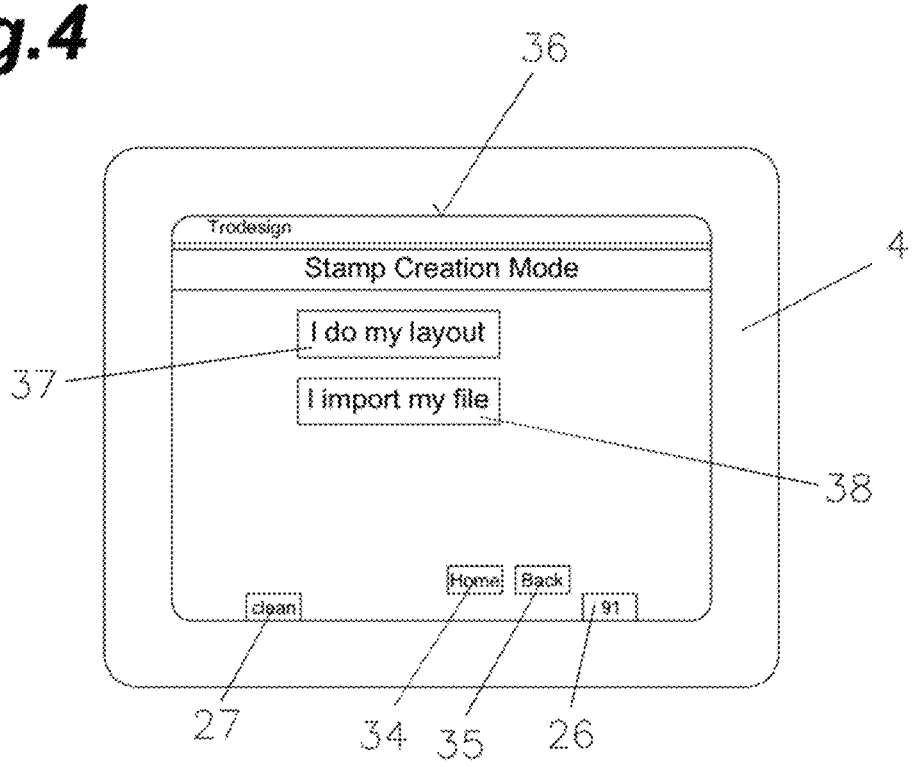
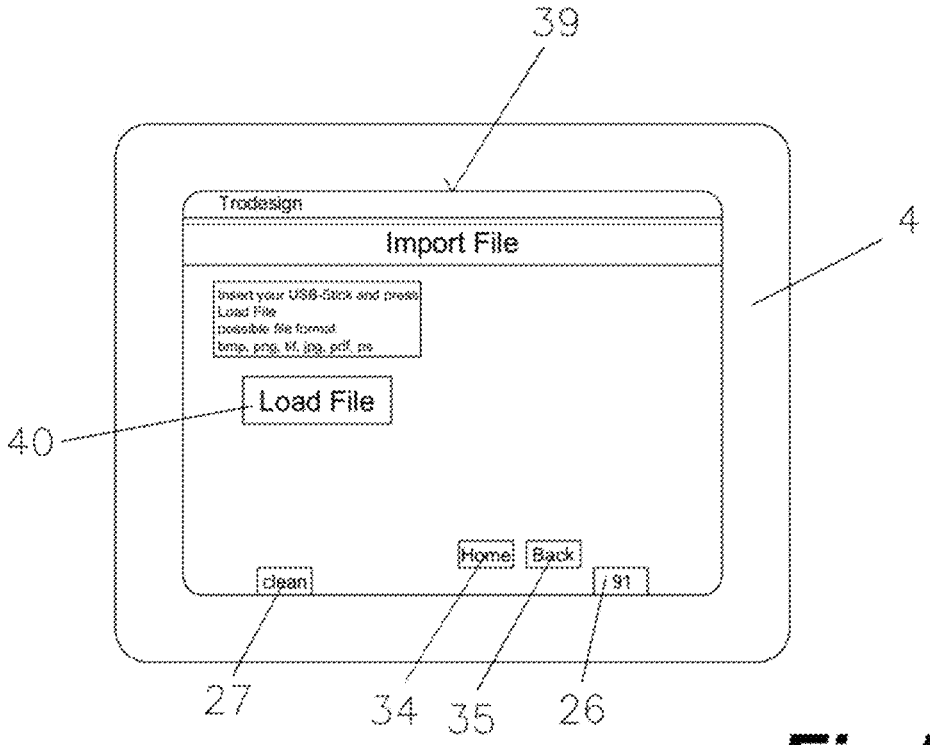
Fig.5

Fig.6
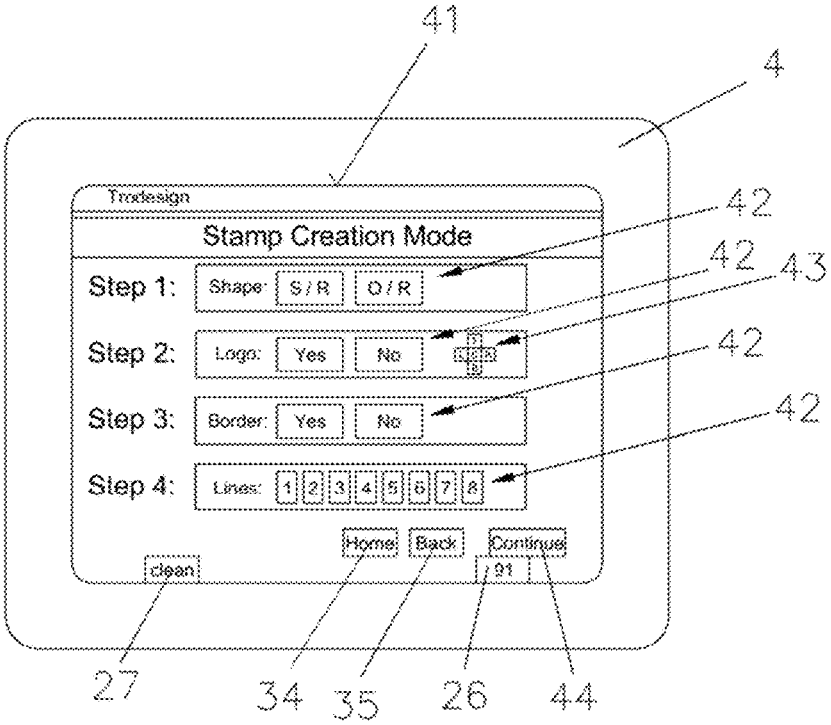
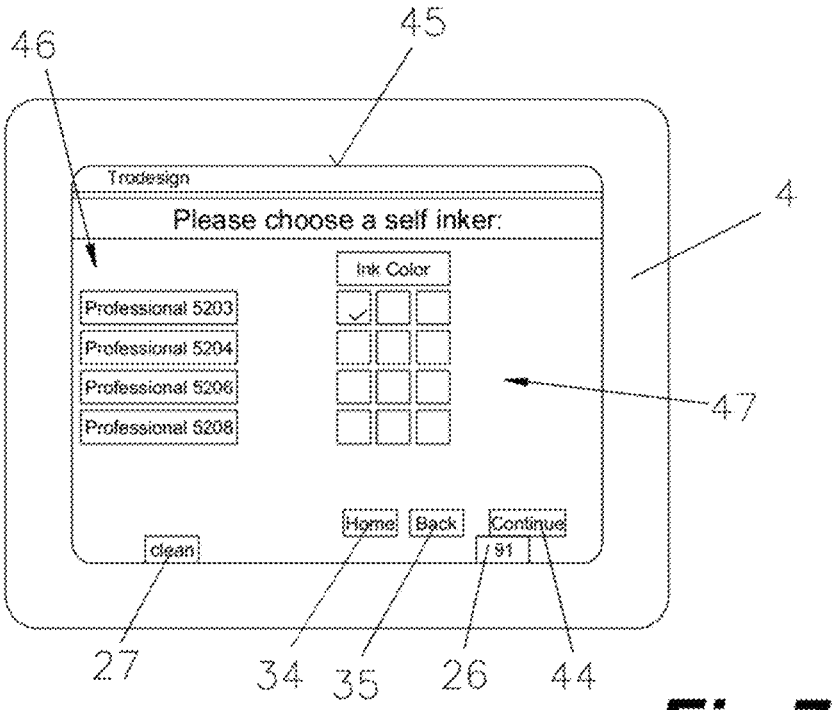
Fig.7

Fig.8
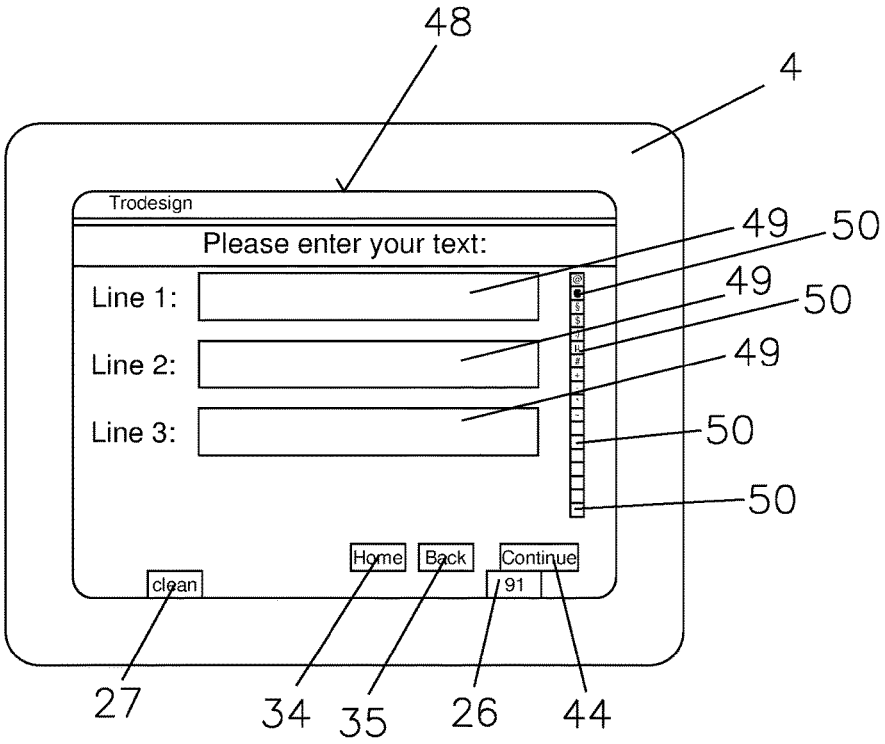
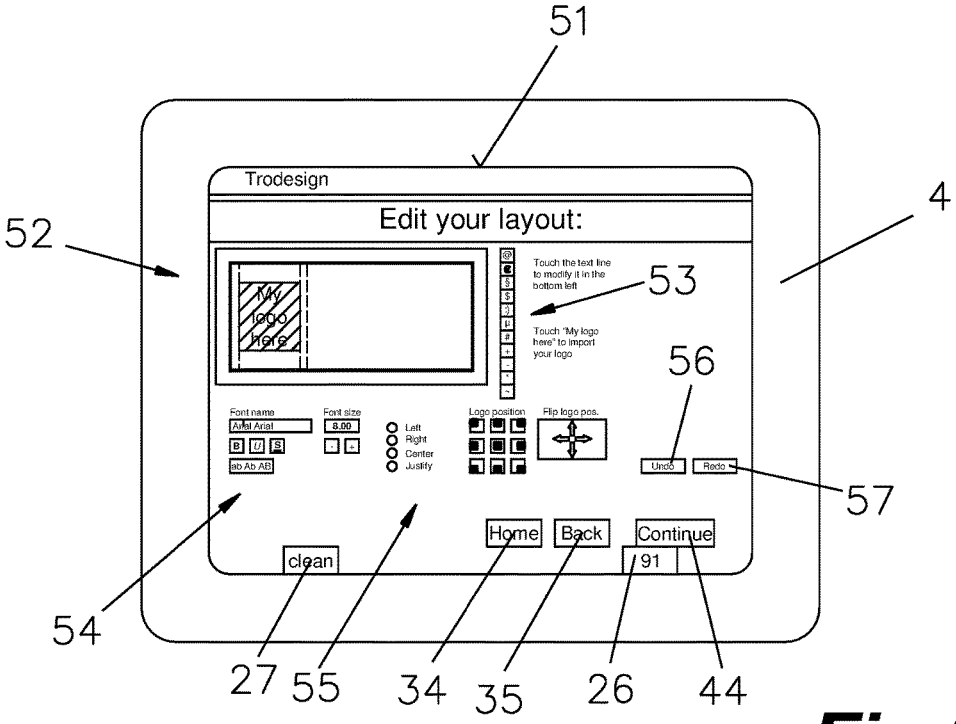
Fig.9

Fig.10
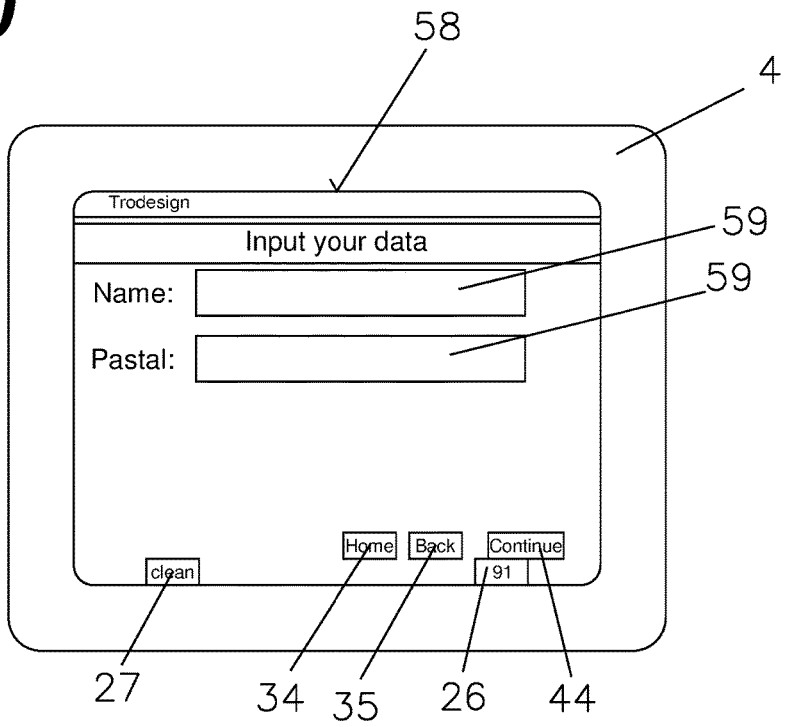
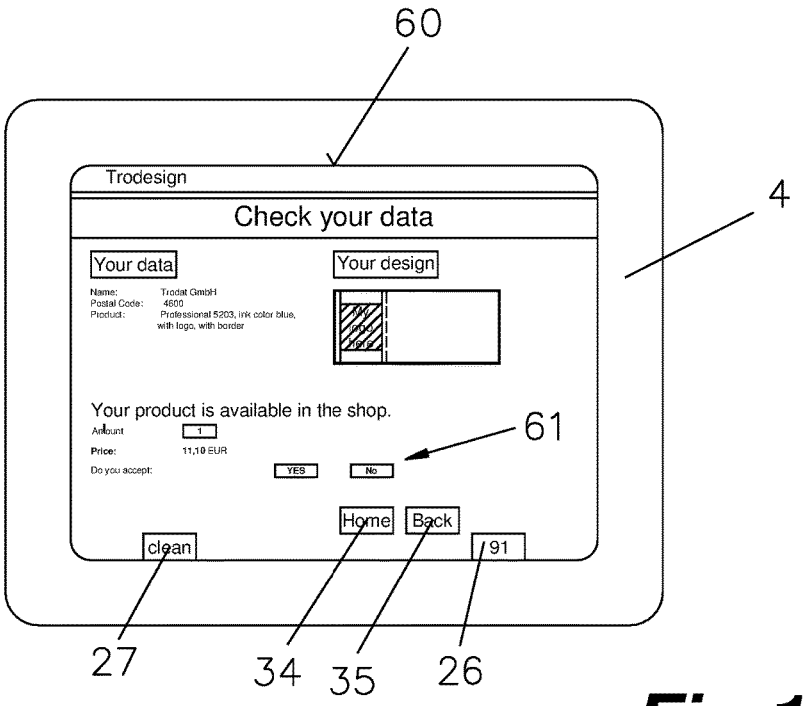
Fig.11

Fig.12
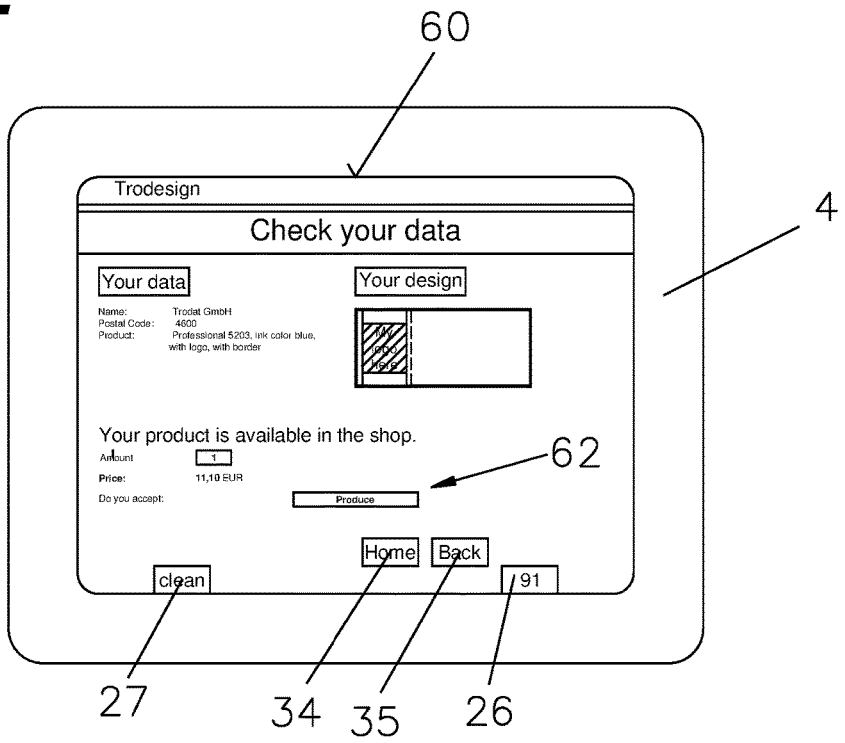
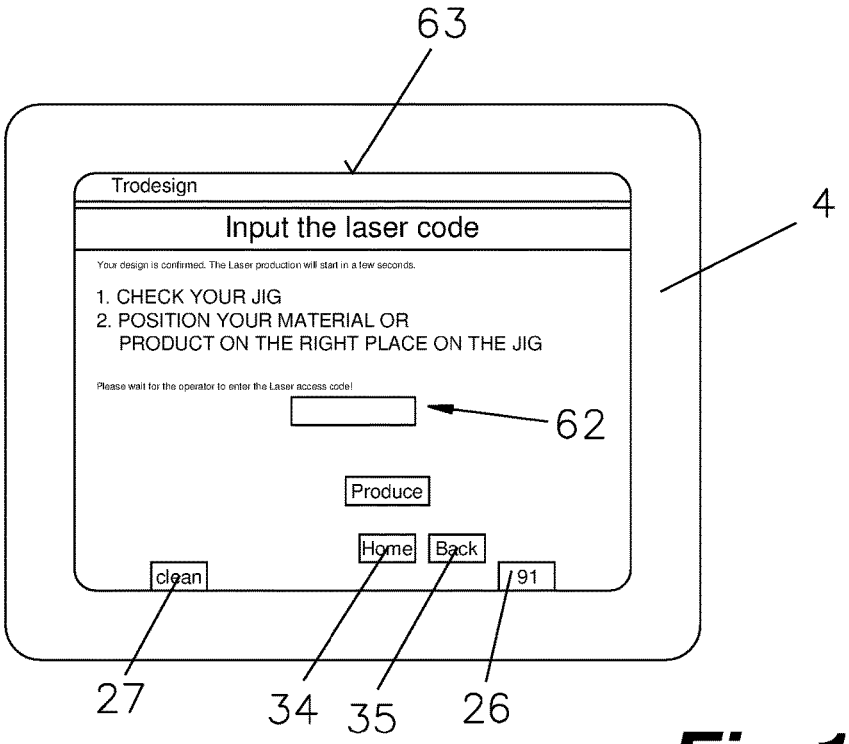
Fig.13

Fig.14
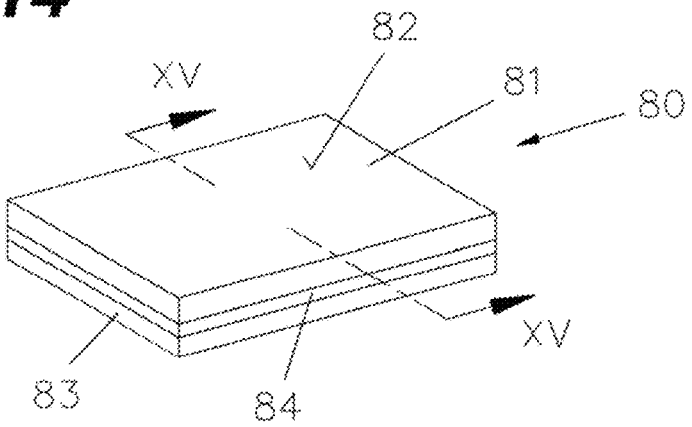
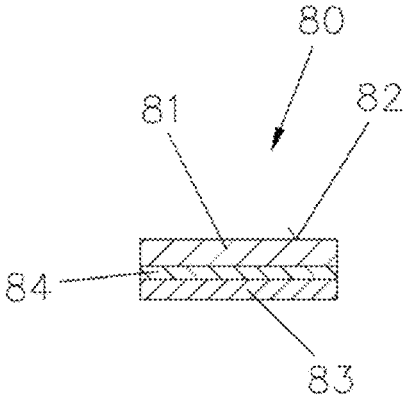
Fig.15
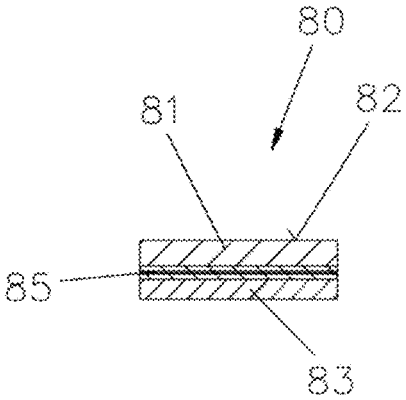
Fig.16

Fig.17
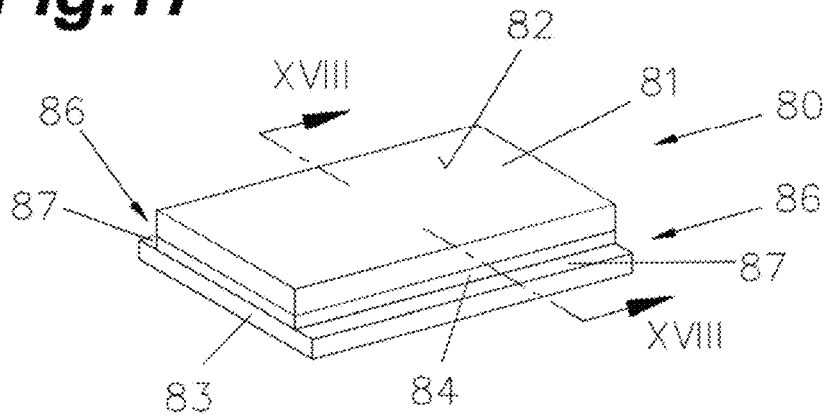
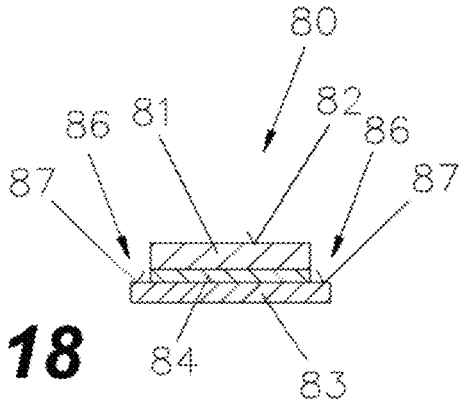
Fig.18
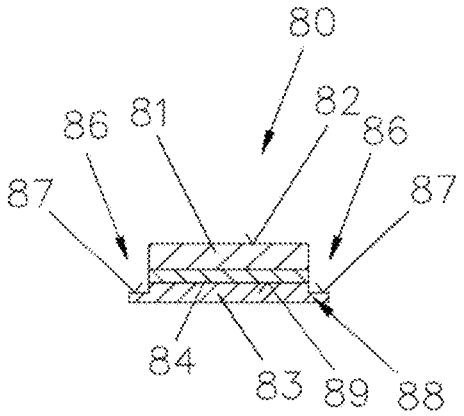
Fig.19
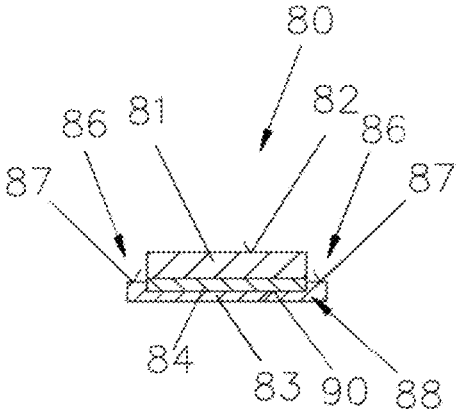
Fig.20

Fig.21
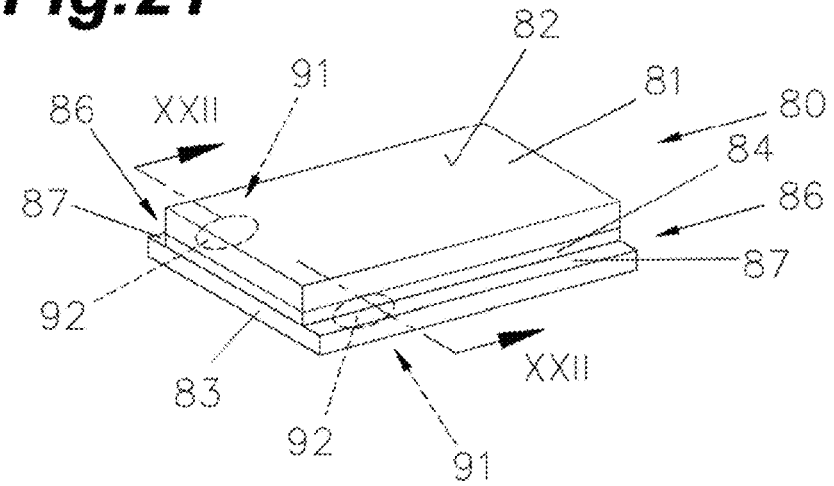
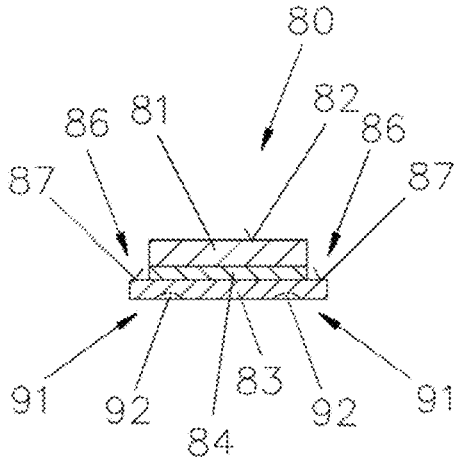
Fig.22
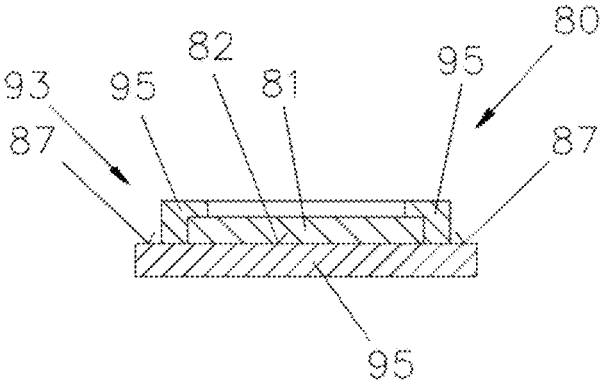
Fig.23

SYSTEM FOR PREPARING AND PRODUCING A STAMP PLATE

BACKGROUND OF THE INVENTION

The invention relates to a system, a stamp plate blank, a processing insert, a laser plotter, a method for producing a text plate, a method for positioning and removing an insert, and a method for mounting the text plate.

BRIEF SUMMARY OF THE INVENTION

Systems are known from the prior art with which, by specially trained personnel known as stamp makers, the plates or text plates for stamp plates, in particular hand stamps, are produced. To do this, specialist personnel design on a computer, with the aid of standardized software, in particular Corel-Draw, Word, etc., a stamp image by means of graphics and/or texts according to the customer's wishes. The data is then transferred to a processing device, in particular a laser plotter, or a control device for this, whereupon a conversion of the data takes place, preferably with the aid of deposited data and/or tables. The specialist personnel then lay what is referred to as a blank, which is formed from flexible rubber, into the processing device, whereupon a manual and/or automatic positioning of the processing device, in particular of a beam source of a laser, takes place. The specialist personnel then start the processing procedure, such that a negative image is produced of the stamp created by the specialist personnel on the computer is produced on the blank. Once the processing procedure has been completed, the specialist personnel remove the blank and clean it of the processing residues. The negative stamp impression is then adhesively bonded onto the printing plate carrier, on which a layer of adhesive has already been applied, or the specialist personnel cut a double-sided adhesive tape to size and attach it to the blank, or, respectively, to the negative stamp plate and the stamp plate, then onto the printing plate carrier, without a layer of adhesive on the stamp, such that the finished stamp can then be sent to the customer.

Disadvantageous in this situation is the fact that the present arrangement is very complicated in its sequence, and therefore specialist personnel are always necessary to operate the software and the processing device.

A substantial disadvantage also lies in the fact that the customer, when purchasing the stamp, cannot take the stamp with the desired stamp plate straight home, but rather that the customer must send in a card with the desired text, so that, some time later, the stamp with the fitted stamp plate is sent to the customer, or the customer is sent the finished stamp plate, which he then must adhesively bond to the printing plate carrier himself.

Also known from the prior art of the Applicants is an ordering procedure or an online shop solution by the name of "uTypia", with which the customer can order a text place via a computer, which is then sent to him.

Disadvantageous in this situation is the fact that the customer only receives the stamp or the stamp plate some time later. This also gives rise to the disadvantage that any changes which the customer wishes to make to the stamp impression, which often do not become evident until the stamp is used, cannot be put into effect straight away, but instead the online order procedure must be carried out again. As well as this, with the online ordering procedure, the stamp impression ordered by the customer must be checked again by the specialist personnel, in particular stamp makers, and it may happen that slight adjustments still have to be made by them which have not been agreed with the customer, or must be agreed on in a further intermediate step.

The object of the invention is to provide a system, in particular a method, with which, without special previous knowledge, the production of a stamp plate for a stamp can be carried out on the spot.

A further object of the invention is to provide a stamp plate blank, a processing insert, in particular a tray or jig, a laser plotter, and corresponding methods, with which the procedure is made very much simpler and, as far as possible, many sources of error will be avoided.

A further object of the invention is to avoid the known disadvantages from the prior art and to provide improvements.

The object of the invention is solved by a system with which the processing device, in particular a laser plotter, comprises a processing table, which is designed to accommodate and position the processing insert, in particular a tray or jig, wherein an extraction aid is allocated to at least one aperture of the processing insert, and/or preferably this aperture comprises means for guiding and positioning the insert, in particular the stamp plate blank and/or the workpiece, and that, in order to obtain a flat surface of a base material for its further processing, the stamp plate blank is positioned in a removable manner on a base plate.

Advantageous in this situation is the fact that, by this method, an arrangement is provided which does not require any specialist personnel. In this situation, it is sufficient for a purchaser to be given instructions on the spot, who can carry out the individual steps of the work himself, since all the components are designed to be particularly user-friendly. It is further of advantage that the customer can participate directly in the creation of his stamp plate, in that he first creates the stamp impression on the spot and can then observe how the stamp impression is produced. It is therefore possible for the customer, if he does not like the finished stamp impression, to make changes and initiate a new processing sequence. The customer can also, within a few minutes, take his stamp with the stamp impression produced home with him, and does not need to wait several days as is the case with the prior art.

A substantial advantage lies in particular in the fact that the customer can himself develop the layout on the spot by simple aids in the software. A further advantage lies in the fact that greater flexibility can be achieved in comparison with other methods which are used in the same context, such as, for example, a flash stamp device, which, for example, can only make stamps, while, by contrast, with the solution according to the invention it is also possible for signs and personalization engravings for other objects to be produced.

Due to the fact that the system for carrying out the method is embodied and the embodiment with which the stamp plate blank is embodied, the processing insert, and the processing device, in particular the laser plotter, the situation is advantageously attained in that, thanks to the handling characteristics, the operation of the individual components is substantially improved. It is therefore possible for such a system to be operated without specialist personnel.

The objects of the invention are also solved, however, by a stamp plate blank with which, in order to obtain a flat surface of the base material for its further processing, the base material is positioned in a removable manner on a base plate.

Advantageous in this situation is the fact that, thanks to the arrangement of the base material on a stable base plate, it is ensured that the surface of the base material is formed flat, i.e. that at insertion no unevenness can occur, as is the case with the prior art. This also achieves the situation that such an arrangement always ensures the same distance interval to the processing head of a processing device, in particular the focusing unit of a laser plotter. This excludes the possibility of erroneous processing occurring due to different heights of the base material. A further substantial advantage lies in the fact that, due to the use of a base plate, a substantial safety factor is achieved with the laser processing, since, during the processing, in particular the cutting of the base material, an additional layer is now present between the processing insert and the base material, such that the destruction of the processing insert, in particular of the tray, due to imprecise height adjustment can be easily avoided, i.e. that the laser, when cutting through the base material, does not reach directly onto the processing insert, but rather that the beam first impinges onto the base plate of the stamp plate blank, such that only the cheap base plate can be destroyed by the laser. Accordingly, it is no longer necessary for an exact adjustment of the height of the processing table to be carried out by specialist personnel, but instead this can be carried out automatically, since there is adequate room for manoeuvre for the height adjustment. The handling characteristics are also improved by such an arrangement of the blank.

With an embodiment in which an adhesive layer, in particular a double-sided adhesive tape, is arranged for the securing of the base material on the base plate, the situation is advantageously attained in which a rapid and economical production of a blank with very good processing and handling characteristics is achieved.

Of advantage is an embodiment in which the adhesive layer adheres to or is arranged at the base material when it is drawn off the base plate, since, as a result of this, the finished stamp impression can be fitted directly onto a printing plate carrier of a stamp, without additional working steps. This further allows for the production costs of the stamp to be reduced, since there is now no need for this to involve a prepared adhesive tape or adhesive layer on the printing plate carrier. This also simplifies the production of the stamp.

The embodiment in which the base material preferably consists of a plastic containing silicone, in particular (vulcanized) rubber, is of advantage inasmuch as this allows for very good and exact processing, for example with a laser plotter. This achieves a very high quality in the production of the stamp impression.

Also advantageous is an embodiment in which the base plate comprises means for the guidance in a corresponding aperture of a processing insert, since this greatly simplifies the positioning of the blank. This also allows for it to be ensured that the blank will be positioned at the correct location for processing without the need for specialist personnel.

In this situation, an embodiment is of advantage in which, in order to form a lateral edge, in particular lateral guide tracks, the base material is embodied as smaller than the base plate, since this makes simple and economical production possible.

An embodiment is also of advantage, however, in which the base plate is embodied, such as to accommodate the base material as a retaining element, in particular of a floor plate and a frame for the insertion of the base material, since in this way the securing of the base material to the base body is no longer necessary, since the base material can be simply laid into the frame structure, and thereby the same handling advantages can be achieved.

With an embodiment in which the stamp plate blank is embodied for insertion into a processing insert, in particular a tray or jig, for further processing, the situation is attained that two corresponding parts are produced, such that the insertion and removal of the blank can be carried out without prior knowledge being necessary.

The embodiment is of advantage in which the base plate comprises on at least one side positioning means for the locating of the base material and/or for positioning in a processing insert, in particular a tray or a jig, since in this way an exact positioning of the blank can be achieved. This also attains the situation that, at the insertion of the blank, the customer or seller receives an acknowledgment indication, since a form of snap-in connection is effected for the positioning.

Also of advantage is an embodiment in which, for different stamp impression shapes, in particular circular, oval, or triangular, the base plate is formed as rectangular or square, or, with adapted stamp impression shapes, guides are arranged for accommodating it in the processing insert, since in this way several different blanks with preferred different shapes can be inserted in one aperture. This achieves considerable space saving in the processing insert, such that it does not need to be replaced so frequently.

The objects of the invention are also solved by a processing insert, in particular a tray or jig, with which a removal aid is allocated to at least one aperture and/or this aperture preferably comprises means for guiding and positioning of the blank or workpiece, in particular of a stamp plate blank and/or the workpiece.

Of advantage in this situation is the fact that this makes it possible for the first time, when removing the insert, for the user to do this by way of the removal aid. With flat plate-shaped objects in particular, as is the case with a stamp plate, there are often problems in getting them out of the aperture.

A further advantage lies in the fact that the removal aid can also be used at the same time for positioning the insert, such that the user is supported by the insertion aid when inserting and removing the insert. This also achieves exactly the same positioning of the insert at all times even with different users. Operation and handling are also made very much easier as a result of this.

In an embodiment in which the means in the apertures are provided in the form of a guide track, the situation is achieved in which the user needs only to push the blank into the aperture, or push it out respectively. At the same time, the presence of the guide achieves secure retention during processing.

An embodiment is also of advantage, however, in which a monitoring means for identifying the insert, in particular the stamp plate blank, is arranged at the at least one aperture with the removal aid or means, since this will exclude sources of error at insertion. If the incorrect blank is inserted, the means will automatically identify this and the processing procedure will not start at all. It is of advantage in this situation if, in the event of an incorrect blank being inserted, an error message is displayed on the screen of the input device.

An embodiment is advantageous with which a means for illuminating the aperture is allocated to the at least one opening with the removal aid or means, since this will indicate visually to the user, by way of the lighting means, the position for the insertion of the blank.

The embodiment is of advantage in which fixed or removable corresponding means for insertion into the apertures are arranged at the workpiece or the stamp plate blank, since this allows for other set-ups, in particular workpieces, to be used, wherein corresponding defined positions are provided by way of the apertures. This also allows for a certain degree of fixation for the processing.

With the embodiment in which a plurality of apertures of different sizes are arranged on the base body, preferably corresponding to the possible stamp sizes of a stamp, the situation is advantageously attained that, for example, with one insert an entire stamp series is covered, such that the changes of the insert can be kept as few as possible. It is also possible that for the most widely differing stamp series the individual apertures are present on one insert, or are combinable with one another.

An embodiment is also of advantage with which a means for the identification and/or storage of data is arranged on the base body, since this allows for important information to be stored directly on the processing insert. This data can then be transferred automatically to the processing device when an insertion into the device takes place. This also allows for an update for new stamp sizes or stamp series to be carried out easily.

An embodiment is of advantage with which the removal aid is formed by a preferably obliquely running ramp or a lifter or a pivoting floor plate, etc., since this allows for the blank to be lifted or pushed easily out of the aperture. In this situation it is also possible, for example, for a depression to be arranged in the contact surface, into which a finger can be introduced, such that the blank can then easily be lifted.

Also of advantage is an embodiment with which cavities or guide channels are arranged in the base body for accommodating electrical components, such as sensors, leads, etc., since this ensures a high standard of reliability for the monitoring of the position. This also allows the set-up and production of the insert to be made substantially easier.

The embodiment is of advantage with which an interface is arranged on the base body for automatic connection to the processing table for the supply of electrical energy and data transfer, since this means that no cabling needs to be conducted through the body, and the replacement of the insert is therefore easily possible.

The objects of the invention are solved by a laser plotter, with which the processing table is arranged for the accommodation and positioning of a processing insert, in particular a tray or jig.

It is advantageous in this situation that the exact position is specified to the user by the apertures for the insertion of an insert, in particular of a stamp plate blank and/or workpiece, such that sources of error are much minimized. This also makes an automatic positioning of the laser possible, since the apertures are always at the same position, as a result of which an automation effect is created. The user accordingly only needs to lay the insert, in particular the stamp plate blank, into the aperture, such that automatic positioning and processing of the insert then takes place. Another advantage is that, when the processing insert is changed, all that is necessary is for the user to select or input a new number or identifier at the input device, such that, due to the defined positioning, it is immediately possible to start with the processing again.

With an embodiment with which different processing inserts can be inserted, wherein preferably an automatic position determination takes place, it is of advantage that in this situation it is not even necessary for an input in the software to be made. This prevents sources of error due to an incorrect input.

An embodiment is also of advantage, however, with which different processing inserts, in particular trays or jigs, are deposited in a memory unit, in particular in the form of one or more tables, and that at least the start positions for the processing inserts, in particular reference points, are stored for the laser, since this allows for all the necessary data for the most widely differing processing inserts to be made available.

An embodiment is also of advantage, however, with which further data is stored relating to the processing inserts deposited, such as the depth of the aperture, the position height of the processing table, the processing area for the corresponding aperture, the stamp size, and/or the designation of the matching stamp, etc., since in this way the software is constantly provided with the latest stamps and data for the processing, as a result of which the processing quality can be improved.

An embodiment is also of advantage with which a suction device is arranged for cleaning the stamp impression which has been produced, wherein the suction can be moved by the user by means of a hose, since this substantially improves the handling for the cleaning, and therefore no additional cleaning device, in particular a vacuum cleaner, is required.

The objects of the invention are also solved by a method for producing a text plate for a stamp, with which the user first selects a stamp impression size or a stamp, and then, via input means, inputs a text and/or graphics for forming the stamp impression, or the user first produces or creates the stamp impression via the input device with appropriate input means, whereupon the size of the stamp impression and/or the stamp are determined and proposed by the input device and/or control device, in particular the software running therein.

It is advantageous in this situation that the user, in particular the purchaser, can select for himself, on the spot, the size of the stamp or the stamp type, and can then produce the layout. This allows the user to have an influence directly on the appearance of the stamp impression. A substantial advantage lies in the fact that, after the purchase or the layout has been carried out, the user or purchaser can take the finished stamp, with the stamp impression produced on the spot, home with them. In this situation he can observe the processing procedure directly, which makes it possible for the customer to have an influence up until shortly before the start of processing. A particular advantage lies in the fact that, with graphics on the stamp plate, the impression quality with the first draft is not sufficient, such that the resolution must be adjusted. This can be done directly with on-the-spot production, such that the customer no longer encounters any unpleasant surprises, such as is often the case with the prior art, when the stamp plate or the stamp are sent to the customer later.

With a procedure with which the proposed stamp impression size and/or stamp can be adopted by the user, or another stamp impression and/or stamp can be selected, it is of advantage that the customer can actively participate in the decision as to how his stamp should finally appear. In particular, a change in the size of the stamp or the stamp impression may be necessary if the customer wishes to have a graphic, in particular a logo, on his stamp plate. It often happens that for reasons of costs customers choose a stamp which is too small, as a result of which the quality of the impression, in particular of the graphic or logo, is not achieved which the customer and, in particular, the producer of the stamp, wish to attain.

Measures are also of advantage with which, in the event of a change in the proposed stamp impression size and/or stamp, the stamp impression can be adjusted if necessary by the input device and/or the control device, since this saves the customer from setting up the impression anew. This allows for an automatic adjustment, in particular an enlargement or reduction in size of the already created layout to be undertaken. This also makes possible a simple change between the most widely differing sizes of a stamp type and/or of the stamp type itself. For example, if the customer stores his layout, he can reactivate it later at any time, and, for example, produce a second stamp or another stamp altogether. This is often the case if a customer wishes first to produce an office stamp and then later have a mobile stamp with the same impression, which can be easily adopted by the automatic adjustment.

With a procedure in which, before the production of the stamp impression or after the production of the stamp impression, the costs for the production and/or the appropriate stamp are shown to the user, the customer sees immediately what the stamp costs. Undesirable costs surprises can therefore be avoided.

Of advantage is a procedure with which a check is carried out by the control device and/or the processing device as to whether the insert, in particular the stamp plate blank, has been inserted in the correct aperture of the processing insert, since this can accordingly exclude a source of error. In particular, with so many apertures, it is of advantage if a fully automatic monitoring process is carried out, since this will prevent the destruction of the processing insert.

In addition to this, the objects of the invention are solved by a method for the positioning and removal of an insert, with which a processing insert is positioned at the processing table with at least one aperture, with the removal aid and/or means associated with it, in which a user lays the insert, in particular the stamp plate blank, which is preferably formed from a base plate and the base material arranged on it, into the aperture by means of the introduction aid, in particular by pushing it in, and removes it after processing, in particular by pushing it out.

It is advantageous in this situation that a simple and economical method has been created with which no specialist personnel are required. Due to this substantial simplification the situation is attained in which the customer himself inserts the blank into the aperture and can take it out again. This substantially improves the handling of such a system, such that on-the-spot production becomes possible.

Also of advantage are measures with which means are used at the apertures of the processing insert for guiding the insert, in particular lateral guide tracks, such that reliable positioning can take place. This also ensures that the blank is held in position during processing. In addition to this, it is possible, for example, that during positioning by way of the guide tracks or the means, a certain pressure can be exerted on the blank, such that displacement during the processing procedure is prevented.

A measure with which the insert is pushed with the base plate beneath the lateral guide track of the aperture is of advantage, since the blank can thereby be positioned with a simple pushing movement.

A procedure is also of advantage, however, with which the insertion and removal of the insert takes place manually or automatically, for example by means of a handling device or a robot arm, since this increases the user-friendliness and at the same time sources of error due to incorrectly positioned blanks in the processing insert will be avoided.

In addition to this, the objects of the invention are solved by a method for the mounting of the text plate, with which, during the processing procedure, the base material is positioned on a base plate, in particular adhesively bonded to it, and, after the processing procedure, is drawn off the base plate by the processing device, wherein the adhesive layer remains retained on the base material, and the base material with the adherent layer of adhesive is positioned on the printing plate carrier of the stamp and adhesively bonded to it.

It is advantageous in this situation that this created substantial simplification and the handling is improved to such an extent that the customer himself or a seller can take over the assembly of the stamp plate. This arrangement also attains the result that, during the production of the stamp, simplification is achieved, since the stamp does not now need to comprise a layer of adhesive or adhesive tape for the later fitting of a stamp plate, since this is arranged on the blank. The user only needs to draw the finished and cleaned stamp impression or stamp plate from the base body and then position it on the printing plate carrier.

Finally, a procedure is also of advantage with which the adhesive layer is formed by a double-sided adhesive tape, since this allows for optimum adjustment of the adhesive properties to the different materials, i.e. on the one hand a good adherence for the base material is attained, and, on the other, optimum adherence to the printing plate carrier, wherein the adherence to the base body for the processing is as low as possible, in order for the adhesive tape to remain on the base material when drawing off takes place.

The invention is described hereinafter in the form of embodiments, wherein attention is drawn to the fact that the invention is not restricted to the embodiments or solutions presented or described.

BRIEF DESCRIPTIONS OF THE DRAWINGS

Figure 26:
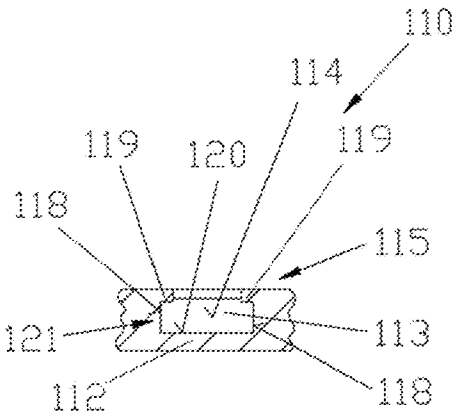
Figure 25:
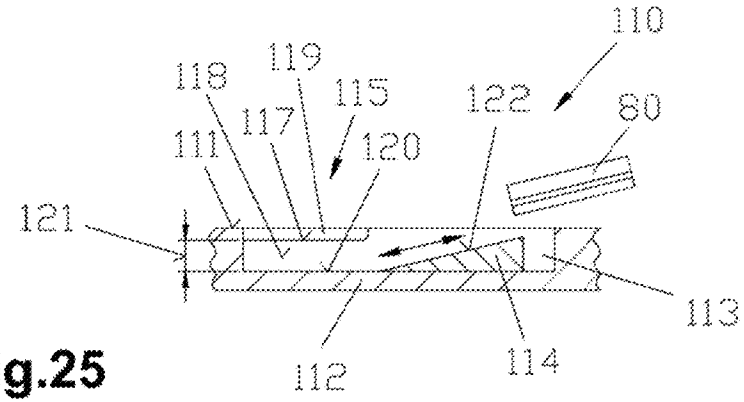
Figure 24:
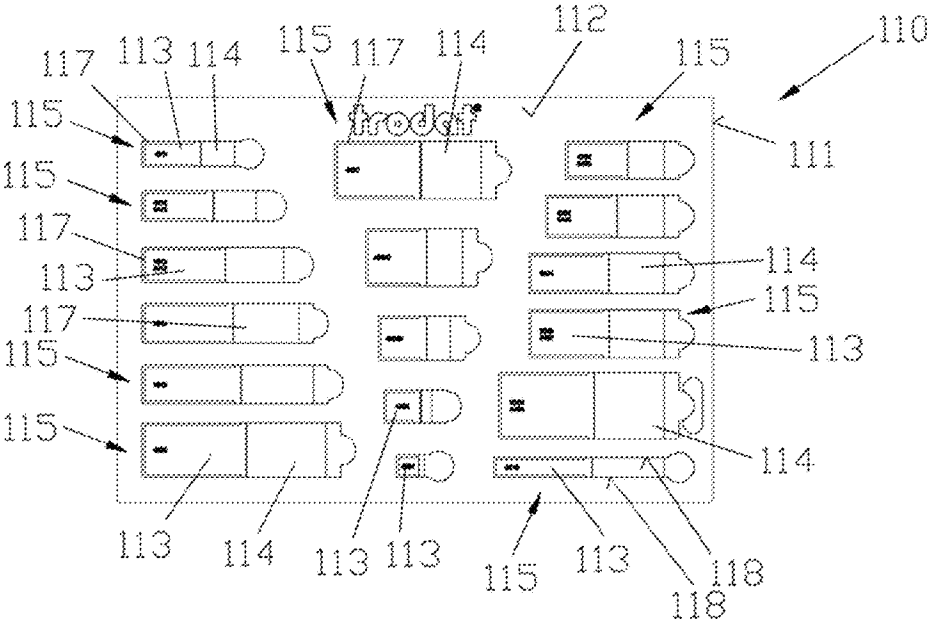
Figure 28:
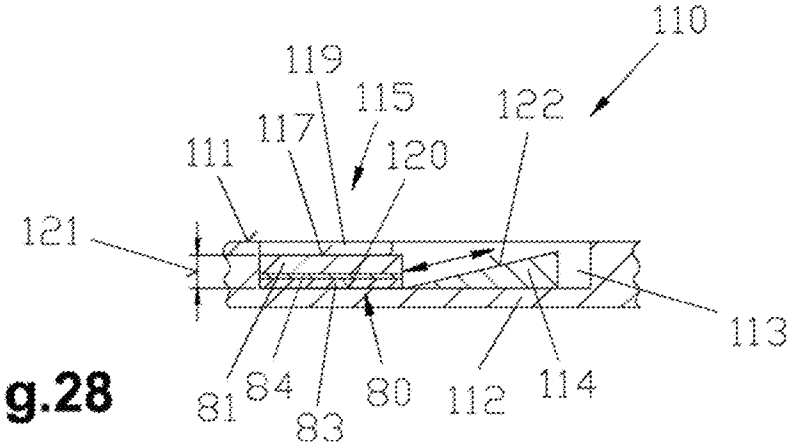
Figure 27:
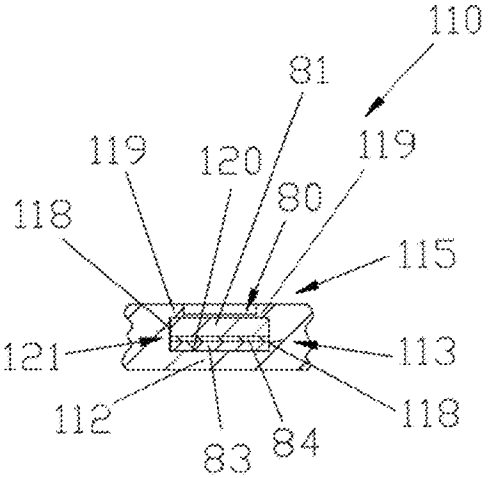
Figure 29:
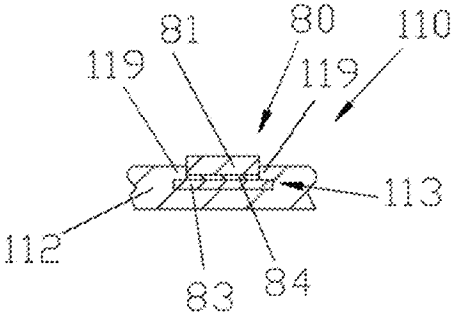
Figure 30:
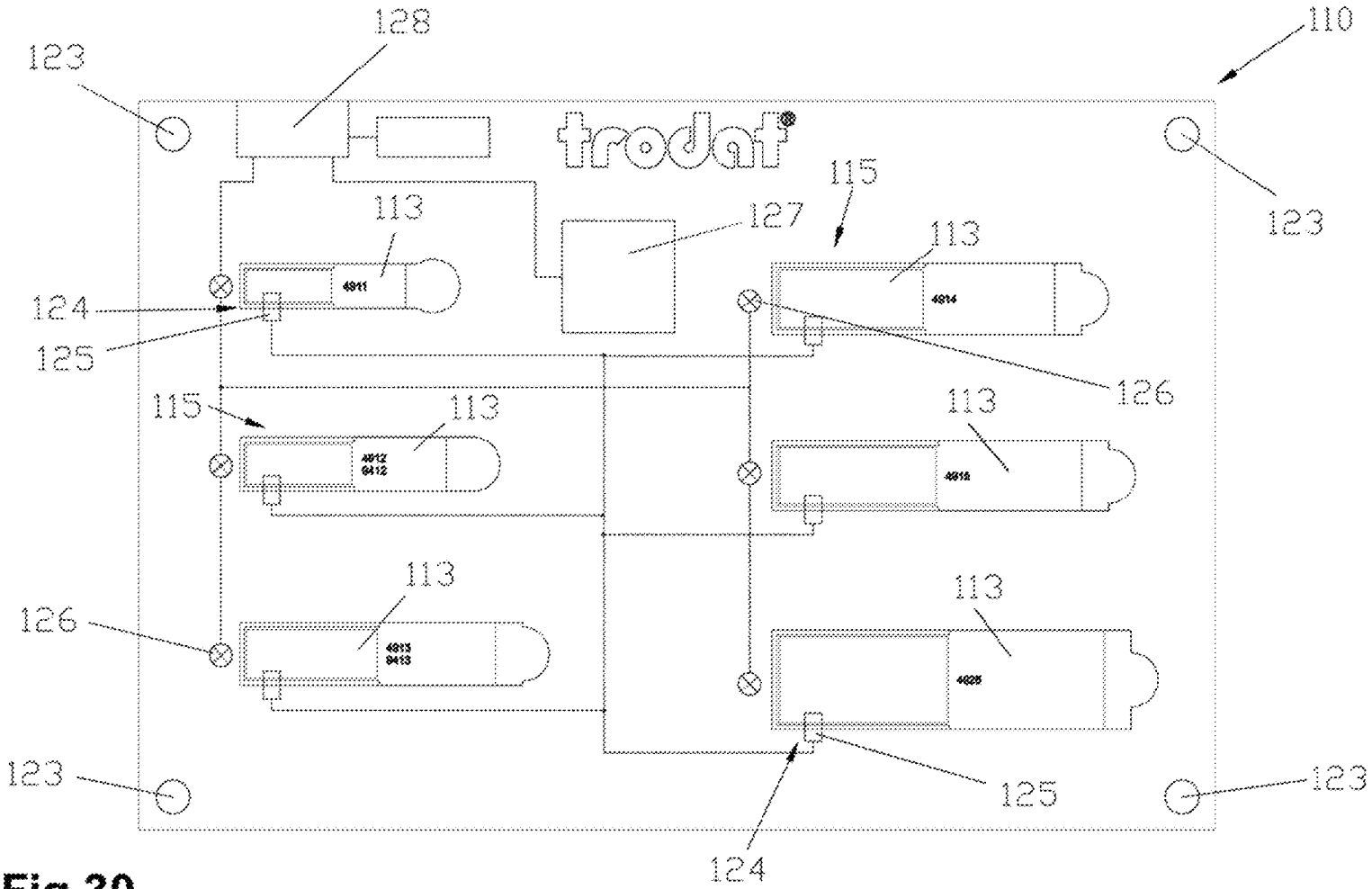

The figures show:

FIG. 1 An overview image of a system for the processing of workpieces and the production of text plates;

FIG. 2 a schematic simplified representation of an input mask on an input device for a method for the preparation and production of a stamp plate;

FIG. 3-13 a further schematic simplified representation of input masks according to FIG. 2;

FIG. 14 a perspective representation of a stamp plate blank, in a simplified schematic representation;

FIG. 15 a sectional representation through the stamp plate blank according to XIV-XIV, in a simplified schematic representation;

FIG. 16 an embodiment of a stamp plate blank from FIGS. 14 and 15, in a sectional view and in a simplified schematic representation;

FIG. 17 a further embodiment in a perspective representation of the stamp plate blank, in a simplified schematic representation;

FIG. 18 a sectional representation through the stamp plate blank according to XVIII-XVIII in FIG. 17;

FIG. 19 an embodiment of the stamp plate blank from FIGS. 17 and 18, in a sectional view and in a simplified schematic representation;

FIG. 20 a further embodiment of the stamp plate blank from FIGS. 17 to 19, in a sectional view and in a simplified schematic representation;

FIG. 21 another embodiment of a stamp plate blank according to FIGS. 14 to 21, in a simplified schematic representation;

FIG. 22 a sectional representation of the embodiment according to FIG. 21, in a simplified schematic representation;

FIG. 23 a further embodiment of a stamp plate blank with a retaining frame, in a simplified schematic representation;

FIG. 24 a view from above onto a processing insert with apertures for the stamp plate blank for a processing device, in a simplified schematic representation;

FIG. 25 a sectional representation of the length through an aperture of the processing insert according to FIG. 24, in a simplified schematic representation;

FIG. 26 a further sectional representation transversely through an aperture of the processing insert according to FIG. 24, in a simplified schematic representation;

FIG. 27 a sectional representation of the processing insert with an inserted stamp plate blank, in a simplified schematic representation;

FIG. 28 a further sectional representation of the length of the processing insert with an inserted stamp plate blank;

FIG. 29 an embodiment of the processing insert with an inserted stamp plate blank, sectional view and in a simplified schematic representation;

FIG. 30 a view from above of an embodiment of a processing insert with electronic components, in a simplified schematic representation.

DETAILED DESCRIPTION

By way of introduction it is pointed out that in the different embodiments the same parts are provided with the same reference numbers and same component designations respectively, wherein the disclosures contained in the description as a whole can be transferred by analogy to the same parts with the same reference numbers and same component designations respectively. Likewise, positional data used in the description, such as top, bottom, lateral, etc. refer to the figure described and, in the event of a change of position are to be transferred by analogy to the new position. Individual features or feature combinations from the embodiments shown and described can also represent inherently independent inventive solutions.

Shown in FIG. 1 is a system 1 for carrying out a method for producing a text plate 2, also referred to as a stamp plate 2, for a stamp 3, in particular a hand stamp, and/or for the processing of workpieces, such as ballpoint pens, writing devices, iPad, iPhone, signs, etc., which comprises at least one input device 4, a control device 5, and a processing device 6, wherein the control device 5 is arranged, for example, in the processing device 6 and/or in the input device 4. At the input device 4, which can be formed, for example, by a laptop, tablet-PC, iPad, or a sales stand with touchscreen and/or input components or the like, a stamp imprint 7 is produced by the user, whereupon the stamp imprint 7 is transferred to the control device 5, and is converted by this or by the processing device in such a way that an actuation of the processing device 6 takes place, to produce a negative stamp impression 7 on an insert 8. It is of course also possible for the conversion of the produced stamp impression 7 into a negative stamp impression to take place in the input device 4, and the data and/or information is then transferred via wires and/or wirelessly, in particular via WLan or Bluetooth.

In the embodiment shown, the processing device 6 is formed by a laser plotter 9, also referred to as a laser engraver, with which several, in particular two, beam sources 11, 12 are arranged and operated in a housing 10 in the form of lasers 13, 14, which preferably alternately take effect on the insert 8 laid therein, in particular a silicone insert 8, or the workpiece which is to be processed, such as a ballpoint pen, iPad, iPhone, etc., wherein the insert 8 or the workpiece is positioned in a defined manner on a processing table 15, and a laser beam 16, emitted by the beam source 11 or 12, is emitted via deflection elements 17 to at least one movable focusing unit 18, arranged for both beam sources 11 or 12, from which the laser beam 16 is deflected in the direction of the workpiece or insert 8, and focussed for the processing. The control, in particular the position control, of the insert 8 or of the workpiece in relation to the laser beam takes place by means of software running in the control unit or control device 5 respectively, which in the embodiment shown is integrated in the laser plotter 9, wherein, at the external input device 4, in particular a computer or a control device 5, a graphic and/or a text is produced, as represented schematically at the computer, which is then transferred to the control device 5 of the laser plotter 9 via a data link 19, which carries out, for example from a databank deposited in a memory 20, a conversion of the transferred data, in particular of the stamp impression 7 with graphics and/or text, to control the individual elements of the laser plotter 9. No further details will be given with regard to the mechanical arrangement of such a laser plotter 9, since this is already known from the prior art, in particular from the Applicants' WO 1999/038643 A, and can be derived from that.

It is of course possible that, instead of a two-beam laser plotter 9, a single-beam laser 13, i.e. equipped with only one beam source 11, can be used. It is also possible for several processing devices 6 to be connected to the input device 4, such that, depending on the selected processing device 6 or the task or the material, the most widely differing processing devices 6 can be selected and activated. Depending on the use of the raw material for a stamp plate 2, another processing device 6, such as a milling machine, is also possible.

Shown in FIGS. 2 to 13 is a sequence for the production of a text plate 2 or stamp plate 2 with the software running at the input device 4, in particular on the display screen and/or touchscreen, as is represented schematically in a simplified manner.

If the user or customer activates the input device 4, there first appears on its display screen the entry mask 21. Represented in the entry mask 21 are the different functions which can be carried out by way of the system 1 or the processing device 6 respectively, in the form of input buttons 22, 23, 24, 25 displayed with images. There is also an information display 26 provided for the operator or seller, from which can be read off how many orders have already been carried out by customers and/or how many orders are pending. Depending on the setting in the software, in particular in the settings of the software, this information display 26 can also serve to allow the seller to see the existing or received online orders, in particular of uTypia, from other sales locations, which he can process later. It is also possible for a Clean button 27 to be provided, wherein, by pressing this Clean button 27, the cleaning function, in particular a cleaning brush can be manually activated in order to clean the text plate 2.

As is now represented in FIG. 2, the following activities are deposited with the input buttons 22 to 25:

| | |
|---|---|
| Input button 22 | Preparation of a text/stamp plate 2 |
| Input button 23 | Engraving of signs |
| Input button 24 | Personalization of your iPad/Tablet-PC |
| Input button 25 | Order via uTypia |

By activation of one of these input buttons 22 to 25 by the customer or seller or operator, a new screen mask is opened at the input device 4, such that, for the further steps, the customer or seller/operator is supported in the input of the required data. In principle it is possible in this situation for images, symbols, photos, and the like to be integrated in the masks displayed, but for the sake of simplicity these have been omitted.

If the input button 22 is activated, the stamp selection mask 28 opens, as is shown better in FIG. 3. In this the customer can now make a selection from among the most widely differing products 29 to 33, which in turn are represented by switch buttons superimposed on images. In this situation, the selection possibilities are not restricted only to the screen mask represented, since this mask is constantly being updated by new introductions of products or the removal of products. The updating of the software or of individual masks can be carried out in this situation on the spot by loading updates or automatically, for example via the Internet. If the customer activates the button 23, a mask opens for the production of images (not shown), from which he can make a selection from a plurality of different formats, shapes, etc., while conversely, by activating the button 24, he can carry out the engraving of a workpiece, in particular of an iPhone, iPad, etc.

By activating the button 22, a new screen mask opens at the input device 4. In this situation, from the Applicants' product selection list 28 in the screen mask displayed, according to FIG. 3, by way of example, the following products can currently be selected:

| | |
|---|---|
| Product 29 | Stamps from the Professional Series (Profi) |
| Product 30 | Stamps of the new Printy 4.0 Generation |
| Product 31 | Mobile Stamps |
| Product 32 | Date Stamp Profi |
| Product 33 | Date Stamp P4 |

It is also possible for corresponding images/symbol images (not shown) for the individual products 29 to 33 to be arranged in the buttons. Two function buttons 34, 35 are also provided, which relate on the one hand to the function button Home 34, by activating which the user can revert back to the entry mask 21, and, on the other, the function button Back 35, with which the user can revert back to the previous mask. These two function buttons 34, 35 can be arranged on any available mask.

If the user now selects a stamp type by activating the corresponding product 29 to 33, a new mask opens, in particular the "Stamp Creation Mode" mask 36, as shown in FIG. 4. With this mask 36 the customer can now decide whether he wishes to produce a layout or whether to input the layout which he has already prepared at home into the input device 4, in particular a data processor or computer, for which purpose an "I do my layout" button 37 and an "I import my file" button 38 are provided.

If the user presses the button 38, the Import File window 39 opens, as shown in FIG. 5. In this the user can now determine which data he can import in which format. In particular, data can be loaded in the formats "bmp, png, tif, pdf, ps", for which purpose the user can, for example, insert or connect a USB stick to a USB port of the input device 4. If he then activates the Load File button 40, then, for example, a file manager opens, such that the user selects the corresponding data which is then imported. It is of course possible for an automatic data recognition to be carried out, wherein, with several possible data formats on the storage medium, in particular the USB stick, a list is proposed for selection. It is also possible for an external hard drive or other storage media to be connected to the USB port. It is also possible, with existing drive stations, for disk storage media to be used, in particular CD-Rom, Blue-Ray, Mini-Disk etc.

By the appropriate integration of a mail server it is also possible for the user to send the data, in particular the stamp impression 7 which has been produced, or images/graphics/texts to the input device 4 from his mobile telephone, in particular Smartphone. For this purpose, with the appropriate selection of the function, which in turn can be carried out for example by means of a button (not shown), a corresponding email address can be displayed. This can, however, also be integrated directly in the layout of the software. There is also the possibility of transferring the data/images/texts to the input device 4 via a WLan, infrared interface, or Bluetooth connection.

Preferably, with a procedure via a mail server, the customer is sent an email reply with a code/password, such that, when the corresponding email is opened at the input device 4, a password/code interrogation is carried out on the display screen or touchscreen of the input device 4, before the customer can open the email. This therefore avoids the possibility of a customer opening an email of another customer. It is also possible for the customer to delete his email independently, or that it can be recorded in the input device 4 how long the email is to remain stored. It is also possible that, when an email is sent to the input device 4, the input device 4, in particular the software, sends an email reply, in which the customer is requested to release the email, in particular via a release link. One possibility is also that the customer sends an own password with the email, which he must then input at the input device 4.

After the customer has imported his data, texts, or graphics, he can then continue with the production of the text plate 2, according to FIG. 4, by activating the button 37. In this situation a new input window 41 now opens, "Stamp Creation Mode", as represented in FIG. 6.

Here the customer must now carry out several steps "1 to 4". Several selection buttons 42 are allocated to the individual steps. These selection buttons 42 are preferably arranged in such a way that, when clicked on or activated, they change their colour and/or appearance, such that the customer can identify what he has selected. In the first step, "Step 1", the customer can choose between a square/rectangular "S/R" or oval/round "O/R" plate format. "Step 2" can be selected by "YES or NO", as to whether a logo (image/graphic) is used or not. Additionally, the customer can select the position by means of the position buttons 43 "T=top, R=right, B=bottom, L=left and C=center". In the third step, "Step 3"", a choice is again possible, specifically as to whether the customer wants a border or edging or not, which he can select by Yes or No. The last step in this input window 41 contains the determination of the lines required, "Lines", for the text plate 2, i.e., by activating one of these figures the customer has the corresponding number of lines made available. If the customer selects the number 2, for example, he then has the possibility of entering a text in two lines, while with the number 3 three lines are provided, and so on.

In view of the fact that with this page or mask the customer can only make the selection by way of buttons, he must activate the button 44 "Continue" in order to call up the next mask 45, "Please choose a self inker", according to FIG. 7, in order to be able to continue with the input. On this page the customer is provided with the information as to which stamp sizes 46 are available for the stamp types (Products 29 to 33) which were selected in the stamp selection mask 28. If the customer selected on page 28 the Product 29 "Professional", then he will have available, for example, the stamp sizes 46 which are displayed, "Professional 5203, 5204, 5206, 5208", while, conversely, with Product 30 the stamp sizes 46 "Printy 4910, 4911, 4912, 4913, 4914, 4915" (not shown) etc. would be available. Depending on what was selected in the stamp selection mask 28, the customer will now be shown the product sizes and/or the designs available in this mask 45. In addition, the customer can now select in this mask the colour, by means of the colour selection buttons 47, wherein, for example, as shown, when a colour is selected a small symbol, in particular a tick, appears in the colour selection button 47. It is of course possible here too for the colour and/or appearance of the activated colour selection button 47 to change. With this embodiment, for the Professional Series the colours "blue, black, and red" are available, from which the customer makes a selection. It is also possible for the customer to select several colours of a stamp size 46, such that what is referred to as a "Multi-Colour stamp" is produced. It is also possible for images of the different sizes of the stamp 3 and/or its impression sizes to be additionally displayed. In this situation it is also possible that, with the masks described heretofore or still to be described, the most widely varied sub-masks, listings, etc., which are not shown, can be set up and called up. For example, for a Multi-Colour stamp further colour selection masks or the like can be opened.

Once the customer has selected the colour, he again activates the button 44 "Continue", in order to continue with the settings. The text input mask 48 then appears, "Please enter your text:", according to FIG. 8. Displayed in this mask are now the number of lines, "Line 1 to . . . ", as the customer defined in the input mask 41. In this example shown, the number 3 was selected in the input mask 41, i.e. three lines, such that now the Lines 1 to 3 are displayed. In addition to the labelling "Line 1, Line 2, Line 3", in each case an input field 49 has now been allocated. With the input field the customer can enter a text via the input means, for example in the form of a keyboard. It is also possible that corresponding character input buttons are displayed in the mask 48, which, on activation, insert the corresponding represented symbol in the active line. It is of course possible for an entire keyboard to be imaged. It is also possible that with special symbols, such as the "Smile", for example, sub-windows (not shown) are opened, from which several such or similar symbols can be selected. If the customer discovers, when preparing the text, that he requires another line, for example, or has a line too many, then by using the "Back" button 35 he can jump back and redefine the number of lines in the input window 41. It s of course possible that a correction key or a key for jumping back directly to the input window 41 can be arranged. It is also possible for the lines to be deleted with a Delete button, or for one or more lines to be added by an Add button.

If the customer activates the "Continue" button 44, a new window 51 appears, "Edit your layout", in which the customer is now shown the layout 52 of the stamp plate 2, which he can still change or adjust here. In this window 51, according to FIG. 9, the customer again has all the adjustment possibilities available, which are compiled into the most widely differing sectors, 53 "Special characters", 54 "Text formatting", 55 "Logo Positioning", wherein no greater details will be provided with regard to the individual functions since they function as with word-processing programs. In this way the user can identify immediately, based on the symbols, which function is involved and what will be changed with this. For example, by changing the font name "Arial", the font of the text in the activated first line will be changed. If the customer changes the number under "Font size" then, for example, the size of the text will be changed, and so on. The essential factor in this situation is that the customer is provided with the opportunity of seeing the finished layout 52 before production, and can change and adjust it accordingly, wherein, in the event of a change, the customer can immediately appreciate this in the layout 52 by activating a button or an input. In order that an easy recovery of a change can be carried out, two additional buttons 56, "Undo" and 57 "Redo" are provided, with which the customer can rapidly remove the changes by working back one or more steps. Accordingly, this mask 51 forms the heart of the processing, with direct effects on the design of the stamp impression 7.

If the customer is happy with his layout 52, he again activates the button 44 "Continue", in order to be able to continue with the production of the text/stamp plate 2. In this situation, with the embodiment shown, it is now the case that a customer data mask 58, according to FIG. 10, is opened. In which the customer can input, by way of two input fields 59, his name and the postcode/town of residence. In this situation it is possible, if desired, for other data to be acquired also, such as the address, telephone number, email, etc. It is also possible for the customer not to input any data, and to jump, by way of the button 44 "Continue" straight to the next mask 60, "Check your data", as is represented in FIG. 11.

This mask 60 has the function of notifying the customer again of all the necessary information and the layout 52. In addition, when this mask 60 is opened, the costs are also calculated and displayed under "Price", such that the customer is informed of this. This is important, inasmuch as the customer must consciously agree to the price, for which purpose a corresponding interrogation box 61 with "Yes or No" is provided. If the customer activates the No button of the interrogation box 61, the procedure will be terminated. Conversely, with "YES" the two interrogation buttons 61 will be changed, and a new button 62 "Produce" will now appear, as represented in FIG. 12. If the customer activates this button 62, the processing procedure will now be activated. In this respect, it is possible, for example, that it is only now that the necessary components are supplied with energy, such that, prior to this, they were only in a state of rest, and energy was therefore saved. It is also possible by this activation for a message to be sent to the seller, or, for example, for a display element (not shown) to be activated.

In any event, the activation of the button 62 "Produce" activates and displays a further screen mask 63, "Input the laser code", as can be seen in FIG. 13. This mask 63 contains a number of function and safety instructions, and contains an input field 64, "Laser access code". It is of course possible in this situation for these function and safety instructions also to be checked automatically, for which purpose corresponding sensors or input requirements are used, as will be explained later. It is also possible for the instructions to be represented in the form of questions, which the seller or customer must confirm. Only when all the technical safety instructions have been confirmed will, for example, the input field 64 appear.

With the embodiment shown, the activity by the customer ends with this mask, i.e. to activate the processing procedure the operator or seller respectively is now required, who inputs the activation code in the input field 64 in order to start the processing procedure at the processing device 6. To do this, the seller lays a stamp plate blank 80 in the appropriate place in the processing device 6, and enters the code in the input field 64. The customer can then observe the processing procedure on the spot. Once the processing procedure has ended, the seller takes the negative text plate 2 which has been produced from the stamp plate blank, and mounts this on the stamp 3, such that the customer can now take the finished stamp 3 home with him. Thanks to the present semi-automation and the on-the-spot processing, the customer has his finished text plate available within a few minutes, and does not have to wait several days, as was known from the prior art, for the text plate 2 to be sent to him, or only collect it from the seller after some time.

It is of course also possible, however, for the semi-automatic processing procedure described heretofore to be extended in such a way that the customer carries it out himself, for which purpose, by appropriate warnings, interrogations, and instructions, the customer is guided step by step, with appropriate masks, inputs, and interrogations respectively being displayed. For example, on the basis of the layout 52 and the selected stamp 3, the customer can be issued with the correct stamp plate blank 80 from an automatic stamp plate device (not shown), which he then lays in the processing device 6 with the display of the position and with assistance for input and issue. Only after the processing space has been closed off by a door/flap, and after checking the position of the stamp plate blank 80 and the flap of the processing device 6 will the processing procedure be started. In principle it is possible for this insertion process to be automated likewise, for which purpose, for example, appropriate robot arms or the like can be used.

In addition to this, it is possible, for the preparation of the layout, for technical safety monitoring software to be running in the background. It is possible, for example, that if the layout is changed, in particular with texts which are too large, that they will no longer fit on the text plate size of the selected stamp 3, with the result that a warning message to this effect appears on the screen. At the same time, in this situation, a new stamp 3 of the same series can be proposed by the software, in which the layout would fit, which the customer can accept or reject. It is also possible that monitoring of the text length per line can take place, such that, if the text in a line is too long, the software automatically inserts a new line, to which the customer must again agree. In other words, this means that the proposed stamp impression size 46 and/or the stamp 3 can be accepted by the user, or another stamp impression size 46 and/or stamp 3 can be selected, wherein, with a change in the proposed stamp impression size 46 and/or the stamp 3, the stamp impression 7 can, if necessary, be adjusted by the input device 4 and/or the control device 5. In particular, such changes occur if the user, when preparing the layout, often selects too large a font, or the user's graphics, image or logo are too large, such that they can only be reproduced on the selected stamp 3 with poor quality.

It is also possible for the sequence of the method described heretofore, or, respectively, of the software used in the input device 4 not to be bound to the exact sequence. Instead, it is possible, for example, for the stamp impression size 46 to be selected first, and only then the stamp type or for the matching stamp type to be proposed. In particular, it is possible for further masks or sequences to be used for the preparation of a stamp plate 2 on the spot.

In the following FIGS. 14 to 24, a series of widely differing embodiments of stamp plate blanks 80 are represented.

The stamp plate blank 80 is designed for the processing device 6, in particular the laser plotter 9, for producing the stamp plate 2 for the, in particular hand-actuatable stamp 3. The material which can be processed by the processing device 6 consists of a preferred rubber-type base material 81, in particular a preferred carrier material 81 containing silicone, which is usually very flexible and preferably capable of being processed by a laser 13, 14, in particular curable. In order to attain an even, in particular flat, surface 82 of the base material 81, for further processing the base material 81 is positioned on a base plate 83, such that it can be removed. For this purpose, to secure the base material 81, an adhesive layer 84 is arranged on the base plate 83, wherein the adhesive layer 84 is preferably formed in such a way that a good durable adhesion to a printing plate carrier of the stamp 3 is provided. The adhesive layer 84 consists, for example, of a double-sided adhesive tape 85. The base plate 83 can then be reused after the processing of the base material 81 arranged on it and after the removal of the base material 81, i.e. a base material 81 can again be adhesively bonded on the base plate 83, and therefore a new blank can be provided.

For the production of an insert, in particular of the stamp plate blank 85, the base material 81 is produced corresponding to the size of the base plate 83, in particular cut to size, whereupon the special adhesive layer 84 is applied onto the base material 81 or the base plate 83, preferably in the form of a double-sided adhesive tape 85, and the base material 81 is then secured on the base plate 83 with the adhesive layer 84. This results in the surface 82 of the flexible base material 81 being formed flat and, in particular, straight and even, such that optimum further processing is possible. The handling characteristics are also substantially improved, since the blank is no longer very flexible, as known from the prior art, but is very stable across the base plate 83.

In particular with use in such a system 1 it is important that, in the absence of specialist personnel, the working steps are arranged to be as simple as possible. This includes, as main component of the system 1, the stamp plate blank 85. In order to be able to produce a text plate 2, it is necessary for the base material 81 to be formed in such a way that it can be processed with the processing device 6, i.e. that when the laser plotter 9 is used as the processing device 6, the base material 81 can be processed by the laser 13 or 14, in particular that it can be cured or removed. For this reason, the base material preferably consists of a plastic containing silicone, in particular rubber. The base plate is formed from a solid material, wherein materials can be used for this purpose which preferably exhibit a high rigidity and good surface slip.

The special arrangement, in particular the set-up of the stamp plate blank 80, serves to allow for simple and secure positioning in the processing device 6 to take place. For this purpose, the processing device 6, in particular the laser plotter 9, comprises for the engraving, marking, lettering, and/or processing of an insert, in particular of the stamp plate blanks 80 and/or workpieces, a processing table 15, arranged in which is a processing insert 110, in particular a tray 111 or jig, wherein further details will be provided hereinafter with regard to the special arrangement of the processing insert 110 in FIGS. 25 to 30. The processing insert 110 comprises in this situation a base body 112 with at least one or more apertures 113 for positioning an insert, in particular of the stamp plate blank 80. In this situation, a removal aid 114 is allocated to at least one aperture 113, wherein preferably this aperture 113 comprises means 115 for guiding and positioning the insert, in particular the stamp plate blank 80 and/or the workpiece, i.e. the stamp plate blank 80 is inserted by the user or seller into the apertures 113, wherein this is positioned and guided by the means 115.

As can be seen from the embodiment shown, the base material 81 is arranged on the entire surface of the base plate 83, i.e. the base material 81 extends as far as the edge of the base plate 83, such that, when the stamp plate blank 80 is laid into the processing insert 110, the base plate 83 and the base material 81 are guided by the means 115.

With a further embodiment of the stamp plate blank 80, according to FIGS. 17 to 23, in order to form a lateral edge, in particular means 86 in the form of lateral guide tracks 87, the base material 81 is arranged as smaller than the base plate 83, i.e. the base plate 83 comprises means 86 for guiding the processing inlay 110 in a corresponding aperture 113. The stamp plate blank 80 is therefore arranged for insertion in the processing insert 110, in particular a tray 111 or jig, for further processing, wherein the guiding is now provided exclusively via the base plate 83.

A further embodiment, according to FIGS. 19 to 20, shows that the base plate 83 comprises on at least one side positioning means 88 for the application of the base material 81 and/or for positioning in a processing insert 110, in particular a tray 111 or jig. In this situation it is shown in FIG. 19 that the positioning means 88 is formed for the application of the base material 81 by an elevation 89, while conversely in FIG. 20 the positioning means 88 is formed as a depression 90.

It is further possible for further positioning means 91 to be arranged at the side facing the processing insert 110, or laterally to the base material 81 or the base plate 83 respectively, which serve to provide guiding and positioning in the processing insert 110, i.e. the positioning means 91 for positioning in the processing insert 110, in particular in a tray 111 or jig, are formed by grooves, projections, guide tracks, etc., which are arranged on the opposite side and/or laterally to the base material 81 secured to the base plate 83. In this situation, in interaction with the processing insert 110, a type of snap connection can be attained, such that the user or seller receives a mechanical acknowledgement at the insertion, and therefore knows that the stamp plate blank 80 is correctly positioned. For example, for this purpose semi-circular elevations 116 can be arranged in the aperture 113 of the processing insert 110, and corresponding semicircular depressions 92 at the base plate 83, as shown in FIGS. 21 and 22, such that, on insertion, the stamp plate blank 80 is pushed over the elevation 116, and the elevation 116 then snaps into the depression 92. In this way, for example, a secure and exact retention of the stamp plate blank 80 in the processing insert 110 is attained. It should be mentioned in principle in this respect that all the embodiments of the stamp plate blank 80 are formed in such a way that the base material 81 covers the base body 83 completely, or is formed as smaller.

In a further embodiment, according to FIG. 23, it is shown that the base plate 83 is formed so as to accommodate the base material 81 as a retaining element 93, in particular a retaining frame, for inserting the base material 81. In this situation, the retaining element 92 is formed from two parts, namely a floor plate 94 and a matching frame 95. In order to position the base material 81, the frame 95 is taken off and the base material 81 is positioned on the floor plate 94, for which purpose appropriate assistance means (not shown) are arranged, or the base material 81 is laid in the frame 95. The frame 95 is then placed on the floor plate 94 and connected to it, wherein appropriate snap connections and/or hinges (not shown) are arranged for this purpose. This achieves the situation that the base material 81 is clamped between the two parts, and a secure and firm retention is thereby created, such that the retaining element 93 can then be laid into the aperture 113 of a processing insert 110. By way of this arrangement the adhesive layer 84 can be done without, wherein, of course, additionally an adhesive layer 84 can be used on the floor plate 94.

Preferably the base plate 83 or the retaining element 93 respectively are designed in such a way that the base plate 83 or the retaining element 93 respectively can be reused after the processing of the base material 81 arranged on them, and after the removal of the base material 81, i.e. that a new base material 81 can in turn be adhesively bonded onto the already used base body 83, or, respectively, laid into the retaining element 93.

However, in order to guarantee an optimum and secure positioning as well as simple insertion and removal of the stamp plate blank 80 in the processing insert 110, it is necessary for the processing insert 110 to be appropriately designed so as to correspond to the stamp plate blank 80 and to comprise additional precautionary measures and means of assistance.

With the use of a double-sided adhesive tape 85 it is possible for this to remain adhering to the base material 81 when the base material 81 is removed, such that the base material 81 can then be adhesively bonded with the adhesive tape 85 onto a printing plate carrier of the stamp 2. This allows for the production of the stamp 3 without adhesive tape on the printing plate carrier.

As can now be seen in FIGS. 24 to 30, the processing insert 110 already described heretofore is represented, in particular a tray 111 or jig, as arranged for a laser plotter 9 for the engraving, marking, lettering, and/or processing of an insert, and comprises a base body 112, which is designed, for example, as transparent, with at least one or more apertures 113 for positioning the insert, in particular the stamp plate blank 80, and a removal aid 114 is allocated to at least one aperture 113, wherein preferably this aperture 113 comprises means 115 for guiding and positioning the insert, in particular the stamp plate blank 80 and/or the workpiece.

The means 115 in the apertures 113 are preferably arranged in the form of a guide track 117, wherein the means 115 are arranged in the apertures 113 in the edge area, in particular on longitudinal sides 118, over at least a part area of the edge area, i.e. such that the guide elements do not run the entire length of the longitudinal sides 118, but can form only a part thereof. In this situation it is possible for several interrupted guide elements to be arranged on a longitudinal side 118. The guide track 117 is formed in such a way that a projection 119 is arranged, such that a free space 121 is formed between a contact plane 120 and the projection 119, as can be seen from FIG. 25. Thanks to the free space 121 it is possible for the stamp plate blank 80 to be pushed in between the contact plane 120 and the under edge which faces the contact plane 120, as can be seen in FIGS. 26 and 28. In this situation, FIGS. 26 and 27 show an application in which the stamp plate blank 80 is pushed in with the base material 81 running as far as the edge, while conversely in FIG. 28 only the base body 83 projects into the guide track 117, in particular into the free space 121. It is therefore important that the guide tracks 117 are arranged, depending on the usable stamp plate blank 80, such that different processing inserts 110 are provided for the different stamp plate blanks 80, and these are laid into the processing device 6 as required. It is of course also possible for several same apertures 113 with free spaces 121 of different heights to be present, such that the blank 80 is inserted in the appropriate manner.

In order, however, for the insertion and removal of the stamp plate blanks 80 to be facilitated for the customer or seller, it is possible for at least one, but in particular all, of the apertures 113 to have a removal aid 114 allocated and arranged, which in this situation is arranged fixed or removable in the aperture 113. In this situation, the removal aid 114 is formed by a preferably obliquely running ramp 122, as can be seen in FIG. 26. It is of course possible that, instead of a ramp 122, other removal aids 114 can be used. For example, the removal aid 114 can be formed by a lifter or pivoting floor plate etc. (not shown). It is also possible that, instead of a ramp 122, a special track, in particular an elliptical track, is used, such that, when the blank 80 is pushed out, it is simply lifted out of the aperture 113, and the seller or customer can remove it easily.

Preferably, a plurality of different sized apertures 113 are arranged at the base body 112, preferably of the corresponding possible stamp sizes 46 of a stamp 3, such that only one insert is needed in order to be able to use the greatest number of different stamp plate blanks 80, and therefore the processing insert 110 does not constantly have to be changed. In this situation it is also possible for the base body 112 to be designed as transparent. It is also possible for the base body 112 to be comprised of a plurality of elements, in particular plates. It is of advantage if means 123, in particular guide holes, are arranged at the base body 112, for positioning on the processing table 15, in particular at guide pins, such that, when a processing insert 110 is replaced, a defined position for the processing insert 110 on the processing table 15 is always provided, or the guide pins are arranged at the processing insert 110, and the processing table 15 exhibits corresponding guide holes. It has also transpired that lettering with the stamp type is of advantage, since the customer or seller can also make a visual check as to whether the blank 80 is inserted correctly for processing.

In order for the stamp plate blank 80 to be laid in the correct aperture 113 of the processing insert 110, it is possible for the processing inlay 110 to be equipped with monitoring means 124, in order to be able to carry out an automatic check. In this situation, means 124 for identifying the insert are arranged at the at least one aperture 113 with the removal aid 114 or the means 115, i.e. a sensor 125 is allocated to the apertures 113 for identifying whether a stamp plate blank 80 has been inserted or not. The sensor 125 can, for example, be formed by a mechanical switch sensor, such that, with the stamp plate blank 80 pushed in, the sensor 125 is activated, and therefore this is identified or can be interrogated by the input device 4 and/or the control device 5 and/or the processing device 6. In this situation it is also possible for a light barrier, an infrared sensor, or, for example, an RFID system to be used, with which an element is positioned at the base body 83 of the stamp plate blank 80.

It is also possible for a visual display to be used for the correct aperture 113. To do this, it is possible for a means 126 for illuminating the aperture 113 to be allocated to at least one aperture 113 with the removal aid 114. In this situation the means 126 can be integrated directly in the base body 112, or it can be arranged below at the processing table 15 or above, wherein, at activation, the corresponding aperture 113 is illuminated. This accordingly attains the situation in which the user or seller is already shown, before the insertion, into which aperture 113 the stamp plate blank 80 should be inserted. It is also possible, for example, for an LED to be allocated as the means 126 to each aperture 113, as shown, which can be activated accordingly in order to indicate to the user or seller where he must insert the stamp plate blank 80.

For complete automation and checking it is further possible for a means 127 for the identification and/or storage of data to be arranged in the base body 112. It is also possible for an interface 128 to be arranged at the base body 112 for automatic connection to the processing table 15 for supply with electrical energy and for data transfer, i.e. at the insertion of the processing insert 110, via the interface 128 an electrical and/or optical connection is created or can be connected to another interface (not shown) arranged at the processing table 15 or in the processing space of the processing device 6, by means of which energy and data can be transferred. To do this it is possible that with a modular arrangement, in particular of a plurality of elements arranged above one other, one element of the processing insert 110 comprises cavities, guide channels to accommodate electrical components, such as sensors, wires, etc., such that a simple and economical set-up can thereby be achieved, as is shown schematically. This also substantially increases security and safety. In principle it can be said that it is of course possible that the appropriate precautionary measures and elements for data communication and/or position recognition are provided or arranged at the processing insert 110, in particular at the apertures 112, and/or at the stamp plate blank 80, which are known from the prior art. In this situation it is also possible for a wireless energy transfer and data transfer to be carried out, for which purpose the processing space, in particular the processing table 15, is equipped accordingly.

This also results in the situation that, with a replacement of the processing insert 110, of one or more components of the system, automatic recognition of the newly inserted processing insert 110 is possible, and that data which may be necessary can be transferred from the memory of the processing insert 110 to the components, i.e. that appropriate data, information, etc. is stored at the processing insert 110 which can be called up or transferred. This achieves the situation that for new stamps 3 a new processing insert 110 is produced, and the corresponding necessary data is deposited, such that with already existing installations only the new processing insert 110 must be inserted in order for the system to be provided with the latest data and information. Accordingly, no upkeep whatsoever by specialist personnel is necessary, who would have to transfer the new data and information into the old installations, since this data, updates, etc. are provided via the new processing insert 110.

In order for such precautionary measures to be implemented, it is necessary for the processing devices 6 pertaining to them to be designed accordingly, i.e. that the laser plotter 9 used for the engraving, marking, lettering, and/or processing of an insert, in particular of a stamp plate blank 80 and/or workpiece, comprises at least one processing table 15 for the positioning of the insert 110, at least one beam source 11 or 12 in the form of a laser 13 or 14 with appropriate deflection elements 17 and a preferably movable focussing unit 18 and a control unit or a control device 5 for controlling the individual elements, wherein the control unit or control device 5 respectively is designed at least for the reception of data created at an external component, in particular the input device 4, in particular a graphic and/or text for a stamp impression 2, and that the processing table 15 is designed to accommodate and position the processing insert 110, in particular a tray 111 or jig, according to the embodiments described heretofore, wherein, in this respect, only an illustrative representation of the processing device 6 according to FIG. 1 is shown.

In this situation, the processing device 6, in particular the laser plotter 9, is designed in such a way that different processing inserts 110 can be inserted, wherein preferably an automatic positioning takes place, i.e. after the replacement of a processing insert 110 a new automatic position determination of the starting point is carried out, in particular of the reference point, and of the height of the processing table 15. In this situation it is possible that, in a memory unit, in particular in the form of one or more tables, different processing inserts are deposited, in particular trays or jigs, and that with regard to the processing inserts at least the different start positions, in particular reference points for the laser, are stored. In this situation the user can select from the deposited processing inserts 110 the corresponding inserted processing insert 110, or it is also possible for automatic recognition to be activated, such that the user does not need to adjust anything further after a replacement. With regard to the deposited processing inserts 110, preferably further data is stored, such as the depth of the aperture 113, the position height of the processing table 15, the processing area for the corresponding aperture 113, the stamp size 46, and/or the designation of the matching stamp 3, etc.

Such a laser plotter 9 further exhibits a suction extraction device, wherein the suction extraction device is arranged such as to clean the stamp impression 7 which has been produced, and can be moved by the user by means of a hose, i.e. during the processing procedure in the processing space the suction extraction device is activated and the air in the processing space is extracted, and, after the processing procedure, the hose suction extraction device is activated, such that the user can remove the blank 80 and can clean the finished stamp plate 2 by means of the hose, arranged at which is, for example, a special brush with suction openings at the end. It is of course possible that the hose suction extraction device can also be activated during the processing, or that the user can switch on the hose suction extraction device manually.

Preferably the blown air is adjusted automatically to the processed material, in particular parameter-controlled, in two steps. This is done by an additional larger pump which is switched on during stamp engraving. The blown air nozzle is adjustable in two axes, such that the focus can be targeted relatively precisely. The cleaning brush is automatically switched on after the engraving. This is done with an automatically operating switchover flap for the suction extraction device. The cleaning function can also be switched on manually with the "Clean Button" 27.

In principle it is also possible for a special cleaning device for the stamp plate 2 to be inserted, whereupon automatic cleaning takes place. In this situation, the cleaning device can carry out a liquid cleaning and/or suction cleaning.

An important consideration with the on-the-spot system 1 as represented and described is that the handling characteristics are simplified in such a way that no specialist personnel are required, but instead the system can be carried out on the spot by a seller or by a customer himself, for which reason all the required measures for safety must be taken.

It is also possible that further equivalent embodiments, which are not represented, fall within the scope of protection of the invention. In this respect it is possible, for example, that the guide track 117 is arranged by way of a groove in the base body 112 and in the removal aid 114, wherein, correspondingly, at the stamp plate blank 80 a projection is arranged on the underside, i.e. on the side opposite the base material 81, such that this projection can be located in the groove and, when the stamp plate blank 80 is pushed in or positioned or removed, the blank 80 is guided by the groove. It is also possible for corresponding fixed or removable means for insertion into the apertures 113 to be arranged at the inserted workpiece, such as a ballpoint pen, or at the stamp plate blank 80. In particular, the means can be designed, such as to be attached, for example clipped onto the ballpoint pen, such that this can then be pushed into an aperture by way of these means. For this purpose it is possible that the user carries out in the software a corresponding activity by the selection of a button, and the individual components are then automatically adjusted accordingly.

It is also possible that, for example, a type of lifter is arranged as the removal aid 114 in the aperture 113, which lifts the insert, in particular the stamp plate blank 80 or a workpiece, out of the aperture 113, or that the floor, in particular the contact surface, is designed as movable, such that, by raising this, the components positioned in the aperture 113 are raised, in particular pushed out.

For the sake of good order, reference should finally be made to the fact that, for the better understanding of the set-up of the system 1 and its components and their constituent parts, these have in part been represented not to scale and/or enlarged and/or reduced in size.

It is also possible that individual features or feature combinations from the different embodiments shown and described may also form inherently independent inventive solutions.

The invention claimed is:

1. A stamp plate blank for a processing device for producing a stamp plate for a stamp, the stamp plate blank comprising a flexible base material, wherein the flexible base material comprises a plastic containing silicone; and wherein, when producing the stamp plate, the flexible base material is configured to removably and adhesively engage with a base plate to obtain a flat surface when positioned on a base plate in a removable manner.

2. The stamp plate blank according to claim 1, characterized in that, to secure the base material, an adhesive layer is arranged on the base plate.

3. The stamp plate blank according to claim 2, characterized in that the adhesive layer adheres to or is arranged at the base material when drawn off from the base plate.

4. The stamp plate blank according to claim 1, wherein the plastic containing silicone comprises rubber.

5. The stamp plate blank according to claim 1, characterized in that the base plate comprises lateral guide tracks means for guiding the stamp plate blank in a corresponding aperture of a processing insert.

6. The stamp plate blank according to claim 1, characterized in that, in order to form a lateral edge the base material is designed as smaller than the base plate.

7. The stamp plate blank according to claim 1, characterized in that the base plate, in order to accommodate the base material, is designed as a floor plate and a frame for inserting the base material.

8. The stamp plate blank according to claim 1, characterized in that the stamp plate blank is designed for inserting into a processing insert for further processing.

9. The stamp plate blank according to claim 1, characterized in that the base plate comprises on at least one side positioning means for the application of the base material and/or for positioning in a processing insert.

10. The stamp plate blank according to claim 1, characterized in that for different stamp impression shapes the base plate is designed as rectangular or square, or that, with adjusted stamp impression shapes, guides are arranged for accommodation in the processing insert.

* * * * *